US009949024B2

(12) United States Patent
Chun et al.

(10) Patent No.: US 9,949,024 B2
(45) Date of Patent: Apr. 17, 2018

(54) METHOD AND APPARATUS FOR CONTROLLING OUTPUT BASED ON TYPE OF CONNECTOR

(71) Applicant: Samsung Electronics Co., Ltd., Gyeonggi-do (KR)

(72) Inventors: Youngsoo Chun, Gyeonggi-do (KR); Jaeyoung Shin, Gyeonggi-do (KR); Sangyong Kim, Gyeonggi-do (KR); Jungsik Park, Gyeonggi-do (KR); Kwonho Song, Gyeonggi-do (KR); Sehwan Choi, Gyeonggi-do (KR); Heejun Ryu, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 15/215,202

(22) Filed: Jul. 20, 2016

(65) Prior Publication Data

US 2017/0026745 A1 Jan. 26, 2017

(30) Foreign Application Priority Data

Jul. 20, 2015 (KR) ..... 10-2015-0102640

(51) Int. Cl.
*H04R 3/00* (2006.01)
*H04R 29/00* (2006.01)
(Continued)

(52) U.S. Cl.
CPC ..... *H04R 3/00* (2013.01); *H01R 24/58* (2013.01); *H04R 1/08* (2013.01); *H04R 1/1033* (2013.01);
(Continued)

(58) Field of Classification Search
CPC ..... H04R 1/08; H04R 1/1033; H04R 29/001; H04R 3/00; H04R 1/1041; H04R 5/04;
(Continued)

(56) References Cited

U.S. PATENT DOCUMENTS 6,397,087 B1 5/2002 Kim et al.
7,792,310 B2 9/2010 Lee et al.
(Continued)

FOREIGN PATENT DOCUMENTS

EP 0 999 721 5/2000
JP 2005-318120 11/2005
(Continued)

OTHER PUBLICATIONS

Yangjing: "Quattro Audio System User Guide", MATRIX, XP055325507, May 31, 2011, 11 pages.
(Continued)

*Primary Examiner* — Brenda C Bernardi
(74) *Attorney, Agent, or Firm* — The Farrell Law Firm, P.C.

(57) ABSTRACT

A method of controlling the output according to a type of connector and an electronic device adapted to the method are provided. The method includes determining whether a first, second and third external connector is inserted into a receptacle, via a circuit connected to the receptacle, wherein the receptacle is configured to receive the first, second or third external connector, each of the first and second connector includes a first number of contacts, and the third external connector includes a second number of contacts less than the first number of contacts; providing an audio output signal to the first external connector in a first manner when the first external connector is inserted into the receptacle; providing an audio output signal to the second external connector in a second manner which differs from the first manner when the second external connector is inserted into the receptacle; and providing an audio output signal to the third external connector in a third manner which differs from the first and second manners when the third external connector is inserted into the receptacle.

13 Claims, 26 Drawing Sheets

(51) Int. Cl.

| | |
|---|---|
| ***H04R 1/10*** | (2006.01) |
| ***H01R 24/58*** | (2011.01) |
| ***H04R 1/08*** | (2006.01) |
| *H04R 5/04* | (2006.01) |
| *H01R 105/00* | (2006.01) |
| *H01R 107/00* | (2006.01) |

(52) U.S. Cl.
CPC ..... *H04R 29/001* (2013.01); *H01R 2105/00* (2013.01); *H01R 2107/00* (2013.01); *H04R 1/1041* (2013.01); *H04R 5/04* (2013.01); *H04R 2420/05* (2013.01); *H04R 2420/09* (2013.01)

(58) Field of Classification Search
CPC ..... H04R 2420/09; H01R 24/58; H01R 2105/00; H01R 2107/00
See application file for complete search history.

(56) References Cited

U.S. PATENT DOCUMENTS

| | | | | |
|---|---|---|---|---|
| 8,914,552 | B2 | 12/2014 | Chadbourne et al. | |
| 2008/0318629 | A1 | 12/2008 | Inha et al. | |
| 2011/0005828 | A1 | 1/2011 | Ye et al. | |
| 2011/0116750 | A1 | 5/2011 | Terlizzi et al. | |
| 2013/0034242 | A1 | 2/2013 | Prentice et al. | |
| 2013/0064381 | A1* | 3/2013 | Jeong | H04R 5/04 381/58 |
| 2013/0108064 | A1* | 5/2013 | Kocalar | G01R 31/318572 381/58 |
| 2013/0114824 | A1* | 5/2013 | Wu | H04R 3/12 381/74 |
| 2015/0098579 | A1* | 4/2015 | Holzmann | H04R 5/04 381/71.6 |
| 2015/0358719 | A1* | 12/2015 | Mackay | G06F 11/3051 381/384 |
| 2016/0219359 | A1* | 7/2016 | Kim | H04R 3/00 |

FOREIGN PATENT DOCUMENTS

| | | |
|---|---|---|
| KR | 10-0172494 | 10/1998 |
| KR | 10-0619055 | 8/2006 |

OTHER PUBLICATIONS

European Search Report dated Dec. 12, 2016 issued in counterpart application No. 16180417.4-1901, 12 pages.

* cited by examiner

Default
(Balanced)

Insert/ MIC ON
(Unbalanced)

METHOD AND APPARATUS FOR CONTROLLING OUTPUT BASED ON TYPE OF CONNECTOR

PRIORITY

This application claims priority under 35 U.S.C. § 119(a) to Korean Patent Application filed on Jul. 20, 2015, in the Korean Intellectual Property Office and assigned Serial number 10-2015-0102640, the entire disclosure of which is incorporated herein by reference.

BACKGROUND

1. Field of the Disclosure

The present disclosure relates generally to a method of controlling output based on a type of connector, and more particularly, to a method of controlling the output of the circuit by varying the configuration of a circuit based on a type of connector and an electronic device adapted to the method.

2. Description of Related Art

In recent years, electronic devices such as smartphones, tablet personal computers (PCs), digital cameras, MP3 players, e-book readers, etc. have been generally used in people's daily life. Electronic devices are capable of connecting to external output devices (e.g., earphones, headset, etc.) and also supporting the output of an unbalanced-type of earphones capable of making a call by wire. Electronic devices are capable of supporting a microphone embedded in external output devices. Electronic devices are also capable of supporting external output devices without a microphone to output unbalanced audio signals. Electronic devices may include a connector fitting part (e.g., a socket, a receptacle, etc.) for receiving a connector (e.g., an earphone jack) of an external output device. Examples of the connector of external output devices are 3-, 4-, and 5-conductor versions which have 3, 4 and 5 conductors (contacts), respectively. Most external output devices have a connector of a 3- or 4-conductor version (a 3- or 4-conductor connector). A conventional 4-conductor connector includes standard contacts to support unbalanced-type earphones capable of making a call by wire. Types of earphones may be divided into an unbalanced-type and a balanced-type. Balanced-type earphones are capable of outputting a higher quality audio than unbalanced-type earphones.

Audio signals transmitted from electronic devices may be classified into a balanced-type and an unbalanced-type. Since the balanced-type and an unbalanced-type of audio signals are created with signals that differ from each other, they need individual output contacts configured in different ways. For example, the balanced-type audio signal may be created with an R signal, an L signal, and a G signal, and the unbalanced-type audio signal may be created with an L+ signal, an L− signal, an R+ signal and an R− signal. Conventional electronic devices do not support balanced-type-based audio signals. Therefore, when conventional electronic devices are connected with balanced-type earphones or headsets, they have difficulty in outputting a balanced-type audio of a high quality.

Accordingly, conventional electronic devices may need a separate connector fitting part to support a balanced-type of output devices (e.g., earphones, headsets, etc.). This results in additional costs. Alternatively, conventional electronic device may be implemented to include two 3.5 Φ connector fitting parts with distinguishing marks. However, users may mistake one of the two connector fitting parts and insert a connector into the incorrect fitting part, which causes users inconvenience. Conventional electronic device may also be implemented to include a 3.5 Φ connector fitting part and a 2.5 Φ connector fitting part. However, this asymmetric structure may cause design issues.

SUMMARY

The present disclosure has been made to address the above-mentioned problems and disadvantages, and to provide at least the advantages described below.

Accordingly, an aspect of the present disclosure is to provide an electronic device which allows a connector of an external output device (e.g., a balanced-type or an unbalanced-type) to be connected; identifies a type of the connected external output device; and varies the circuit configuration to support the type of the external output device, without requiring an additional connector fitting part for supporting a balanced-type.

Accordingly, another aspect of the present disclosure is to provide a method for an electronic device to identify a connector of an external output device connected thereto; and support both balanced-type and unbalanced-type audio outputs, based on the configuration of the identified connector.

Accordingly, another aspect of the present disclosure is to provide an electronic device which is capable of varying the circuit configuration depending on whether the connector is a 3- or 5-conductor version, without being limited to only a 4-conductor connector, and outputting a proper audio.

Accordingly, another aspect of the present disclosure is to provide an electronic device with a microphone function which is capable of supporting both balanced-type and unbalanced-type audio outputs.

Accordingly, another aspect of the present disclosure is to provide an electronic device which is capable of minimizing the degradation of audio quality and supporting both balanced-type and unbalanced-type audio outputs without lowering the performance of the audio outputs.

In accordance with an aspect of the present disclosure, an electronic device is provided. The electronic device includes a housing; an opening formed in one side of the housing; a hole communicating with the opening; a receptacle, placed inside the hole, for receiving one of first, second and third external connectors; and a circuit electrically connected to the receptacle. Each of the first and second connectors comprises a first number of contacts. The third external connector comprises a second number of contacts less than the first number of contacts. The circuit identifies which one of the first, second and third external connectors is inserted into the receptacle; provides, when the first external connector is inserted into the receptacle, an audio output signal to the first external connector in a first manner; provides, when the second external connector is inserted into the receptacle, an audio output signal to the second external connector in a second manner which differs from the first manner; and provides, when the third external connector is inserted into the receptacle, an audio output signal to the third external connector in a third manner which differs from the first and second manners.

In accordance with another aspect of the present disclosure, a method of controlling the output based on a type of connector is provided. The method includes determining whether a first, second or third external connector is inserted into a receptacle, via a circuit connected to the receptacle, wherein the receptacle is configured to receive the first, second or third external connector, each of the first and second connector includes a first number of contacts, and the third external connector includes a second number of contacts less than the first number of contacts; providing an audio output signal to the first external connector in a first manner when the first external connector is inserted into the receptacle; providing an audio output signal to the second external connector in a second manner which differs from the first manner when the second external connector is inserted into the receptacle; and providing an audio output signal to the third external connector in a third manner which differs from the first and second manners when the third external connector is inserted into the receptacle.

BRIEF DESCRIPTION OF THE DRAWINGS

The above and other aspects, features and advantages of the present disclosure will be more apparent from the following detailed description, taken in conjunction with the accompanying drawings, in which.

DETAILED DESCRIPTION OF EMBODIMENTS OF THE DISCLOSURE

Figure 1A:
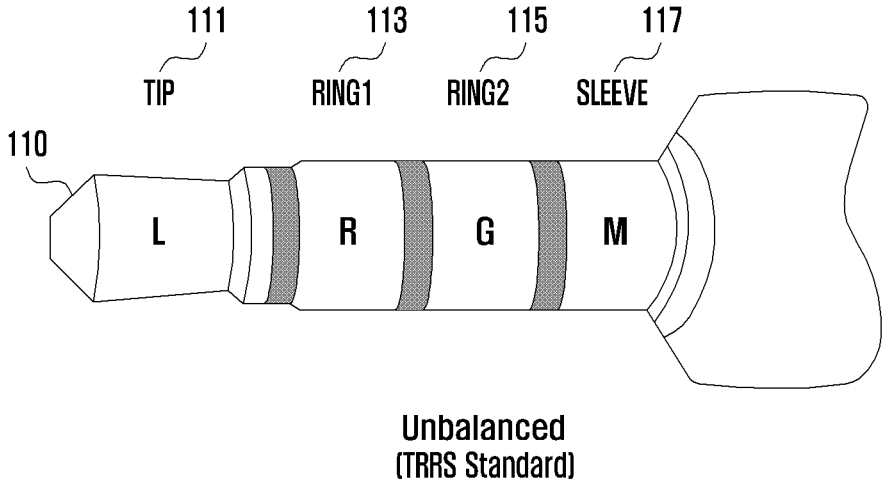
FIGS. 1A and 1B illustrate an unbalanced-type connector and a balanced-type connector, respectively, according to an embodiment of the present disclosure.

Various embodiments of the present disclosure are described with reference to the accompanying drawings, in which like reference numerals refer to like elements. However, the embodiments described herein are not intended to limit the present disclosure to the disclosed embodiments and it should be understood that the embodiments include all changes, equivalents, and substitutes within the spirit and scope of the present disclosure. It will be understood that the expressions "comprises" and "may comprise" are used to specify the presence of a disclosed function, operation, component, etc., but do not preclude the presence of one or more additional functions, operations, components, etc. It will be further understood that the terms "comprises" and/or "has" when used herein, specify the presence of a stated feature, number, step, operation, component, element, or a combination thereof, but do not preclude the presence or addition of one or more other features, numbers, steps, operations, components, elements, or combinations thereof. In the present disclosure, the expression "and/or" is taken as a specific disclosure of each and any combination of enumerated things. For example, "A and/or B" is to be taken as specific disclosure of each of "A", "B", and "A and B".

As used herein, terms such as "first," "second," etc. are used to describe various components, however, the components should not be limited by these terms. For example, the terms do not restrict the order and/or importance of the corresponding components. The terms are used only for distinguishing one component from another component. For example, a first component may be referred to as a second component and, likewise, a second component may also be referred to as a first component, without departing from the scope of the present disclosure.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present.

In the present disclosure, the expression "configured (set or implemented) to do" may be used interchangeably with, for example, "suitable for doing", "having the capacity to do", "designed to do", "adapted to do", "made to do", or "capable of doing." The expression "configured (set or implemented) to do" may not be used to refer to only something in hardware for which it is "specifically designed to do." Instead, the expression "a device configured to do"

may indicate that the device is "capable of doing" something with other devices or parts. For example, the expression "a processor configured (or set) to do A, B and C" may refer to a dedicated processor (e.g., an embedded processor) or a generic-purpose processor (e.g., CPU or application processor) that may execute one or more software programs stored in a memory device to perform corresponding functions.

In the various embodiments, the expression "external output device" refers to a device which is connected to electronic devices and configured to output audio signals. For example, an external output device, such as earphones or headsets, is capable of receiving audio signals from an electronic device and outputting them to the outside. External output devices are capable of receiving audio signals from an electronic device via the connector. External output devices may be classified, based on the configuration of the connector, into an unbalanced-type external output device and a balanced-type external output device. The expression "balanced-type external output device" is also referred to as a "balanced-type connector". A balanced-type external output device is capable of being equipped with a balanced-type connector. A balanced-type external output device is capable of receiving balanced-type audio signals from an electronic device and outputting the audio signals.

In the following various embodiments, the expression "a connector of an external output device" refers to a jack connecting an external output device and an electronic device. The expression "a connector of an external output device" may be configured to transmit/receive audio signals to/from an electronic device and classified into 3-, 4- and 5-conductor connectors. The connector of an external output device may be connected to a "connector fitting part" installed to electronic devices. The "connector fitting part" may be installed to one side of electronic devices and shaped as a hole into which the connector of an external output device is fitted. The "connector fitting part" refers to a socket or a receptacle. The "connector fitting part" electrically connects the contacts, contacting the connector of an external output device, to a processor of an electronic device, thereby transmitting audio signals from the electronic device to the external output device via the connector. For example, for a 4-conductor connector with four contacts, TIP, RING1, RING2, and SLEEVE, the "connector fitting part" may be configured in such a way that it is electrically connected to the corresponding contacts.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

Unless otherwise defined herein, all terms, including technical or scientific terms, used herein have the same meanings as commonly understood by those skilled in the art to which the present disclosure belongs. It will be further understood that terms, such as those defined in commonly used dictionaries, should be interpreted as having a meaning that is consistent with their meaning in the context of the present disclosure and the relevant art and should not be interpreted in an idealized or overly formal sense, unless expressly so defined herein.

According to various embodiments of the present disclosure, the electronic device may include devices having an operation support function. Examples of the electronic device may include a smartphone, Personal Computer (PC), mobile phone, video phone, electronic book (e-book) reader, desktop PC, laptop PC, netbook computer, Personal Digital Assistant (PDA), Portable Multimedia Player (PMP), MP3 player, mobile medical appliance, camera, and wearable device (e.g., head-mounted device (HMD), such as electronic glasses, electronic clothing, electronic bracelet, electronic necklace, electronic appcessory, electronic tattoo, smartwatch, etc.).

According to an embodiment, the electronic device may be one of smart home appliances having an operation support function. Examples of the smart electronic appliance as an electronic device may include a television, Digital Versatile Disk (DVD) player, audio player, refrigerator, air-conditioner, vacuum cleaner, electronic oven, microwave oven, laundry machine, air cleaner, set-to box, TV box (e.g. Samsung HomeSync™, Apple TV™, and Google TV™, game console, electronic dictionary, electronic key, camcorder, and electronic frame, etc.

According to an embodiment, examples of the electronic device may include a medical device (e.g., a magnetic resonance angiography (MRA) device, magnetic resonance imaging (MRI) device, and computed tomography (CT) device), navigation device, global positioning system (GPS) receiver, event data recorder (EDR), flight data recorder (FDR), car infotainment device, maritime electronic device (e.g., maritime navigation device and gyro compass), aviation electronic device, security device, vehicle head unit, industrial or home robot, automatic teller machine (ATM), point of sales (POS) machine, etc.

According to an embodiment, examples of the electronic device may include a furniture and building/structure having a communication function, electronic board, electronic signature receiving device, projector, and metering device (e.g., water, electric, gas, and electric wave metering devices).

According to various embodiments, the electronic device may be any combination of the aforementioned devices. The electronic device may be a flexible device. The electronic device is not limited to the aforementioned devices.

Descriptions are made of the electronic devices according to various embodiments with reference to accompanying drawings hereinafter. The term 'user' used herein may refer to a person or a device (e.g. artificial intelligence electronic device) using the electronic device.

Figure 1B:
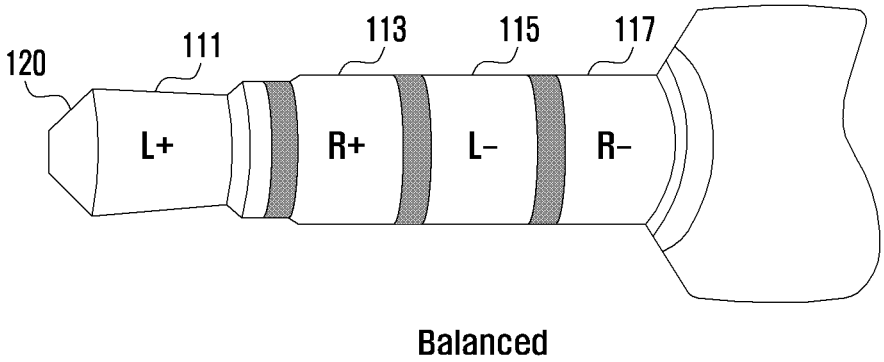

FIGS. 1A and 1B illustrate an unbalanced-type connector and a balanced-type connector, respectively, according to an embodiment of the present disclosure.

Referring to FIG. 1A, an unbalanced-type 4-conductor connector 110 is shown. In general, a connector of external output devices may be 3-, 4-, and 5-conductor versions. As shown in FIG. 1A, the unbalanced-type 4-conductor connector 110 is configured to have four contacts, TIP 111, RING1 113, RING2 115, and SLEEVE 117, which is referred to as a TRRS connector. The unbalanced-type 4-conductor connector 110 is a standard connector. TRRS connectors may differ in contact configuration from each other, depending on the US standard (i.e., sequence of left, right, ground, and microphone (LRGM) signals) and the European standard (i.e., sequence of left, right, microphone, and ground (LRMG) signals). The embodiments of the present invention are described based on a TRRS connector, following the US standard (CTIA (Cellular Telecommunication & Internet Association)). However, it should be understood that the present disclosure is not limited to the US standard. The unbalanced-type 4-conductor connector 110 may be implemented as a TRRS connector, the contacts of which are arranged for left (L), right (R), ground (G), and microphone (M) signals from the tip and inserted into the electronic device in the sequence. That is, the unbalanced-type 4-conductor connector 110 has four contacts arranged in such a way that TIP contact 111 and RING1 contact 113 receive left (L) and right (R) signals from the electronic device, respectively; RING2 contact 115 is connected to the ground (G) contact of the electronic device; and SLEEVE contact 117 transmits audio signals received via the microphone, i.e., a microphone (M) signal, to the electronic device. The unbalanced-type 4-conductor connector 110 receives R and L channel signals from a codec or processor of the electronic device to output the signals to the RING1 contact 113 and the TIP contact 111, respectively. The unbalanced-type 4-conductor connector 110 is capable of being used for a phone function by wire as the contacts are connected to the ground signal and the microphone signal contacts of the electronic device.

Referring to FIG. 1B, a balanced-type 4-conductor connector 120 is shown. Since the balanced-type 4-conductor connector 120 has not been set as a standard connector, its signal configuration may be arranged in a different way from that of a TRRS version. As shown in FIG. 1B, the balanced-type 4-conductor connector 120 has four contacts arranged in such a way that TIP contact 111, RING1 contact 113, RING2 contact 115 and SLEEVE contact 117 corresponds to L+, R+, L−, and R− signals, respectively, thereby being compatible with the unbalanced-type 4-conductor connector 110. The balanced-type 4-conductor connector divides audio signals corresponding to R and L channels, respectively, into + and − signals whose phases differ from each other, and transmitting the + and − signals. For example, an electronic device may transmit R+ signal and R− signals to the R channel output unit of the external output device. Similarly, the electronic device may also transmit L+ signal and L− signals to the L channel output unit of the external output device. In addition, the balanced-type connector may also be implemented with a 5-conductor connector so that one of the five contacts is connected to a contact for a ground (G) signal.

Figure 2A:
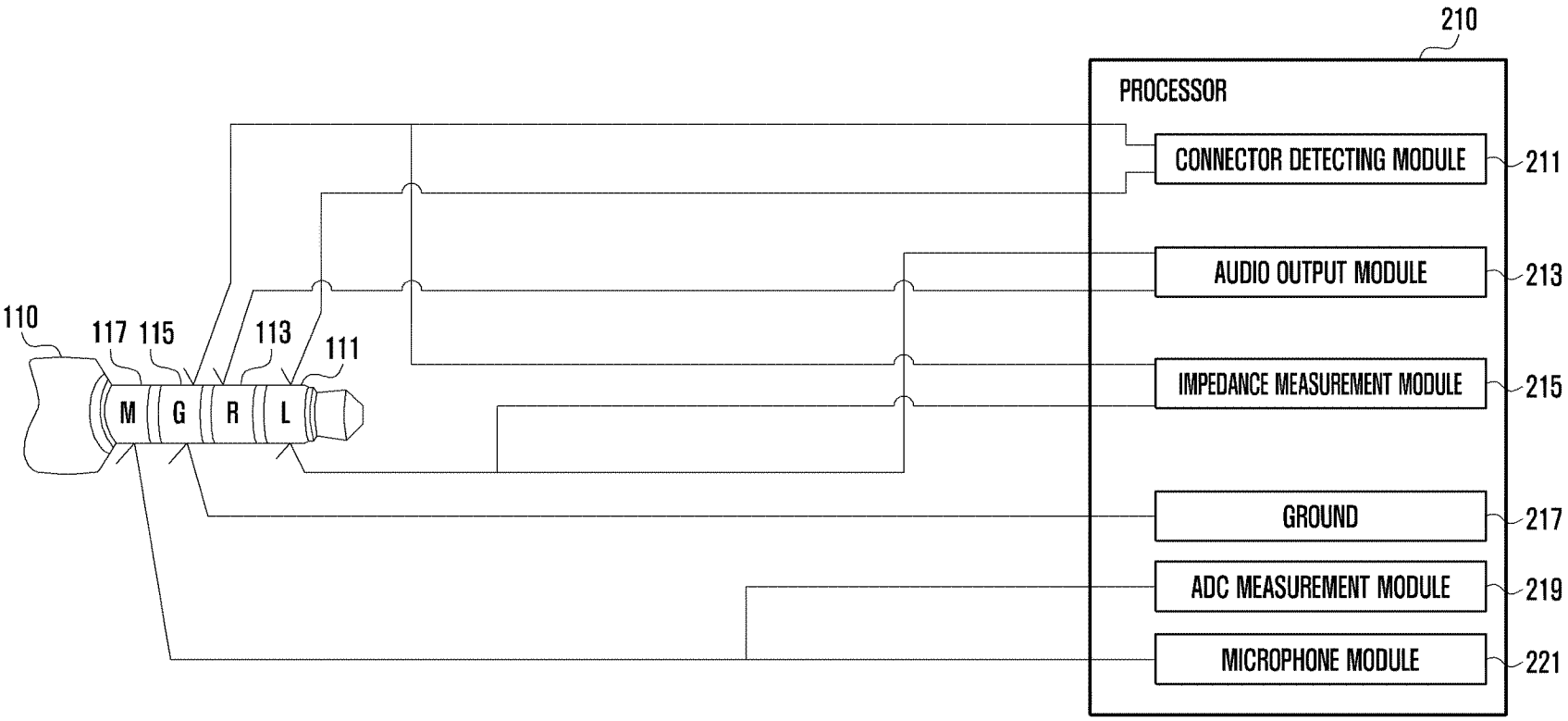
FIGS. 2A and 2B are circuit diagrams of an electronic device supporting an unbalanced-type connector, according to an embodiment of the present disclosure.
Figure 2B:
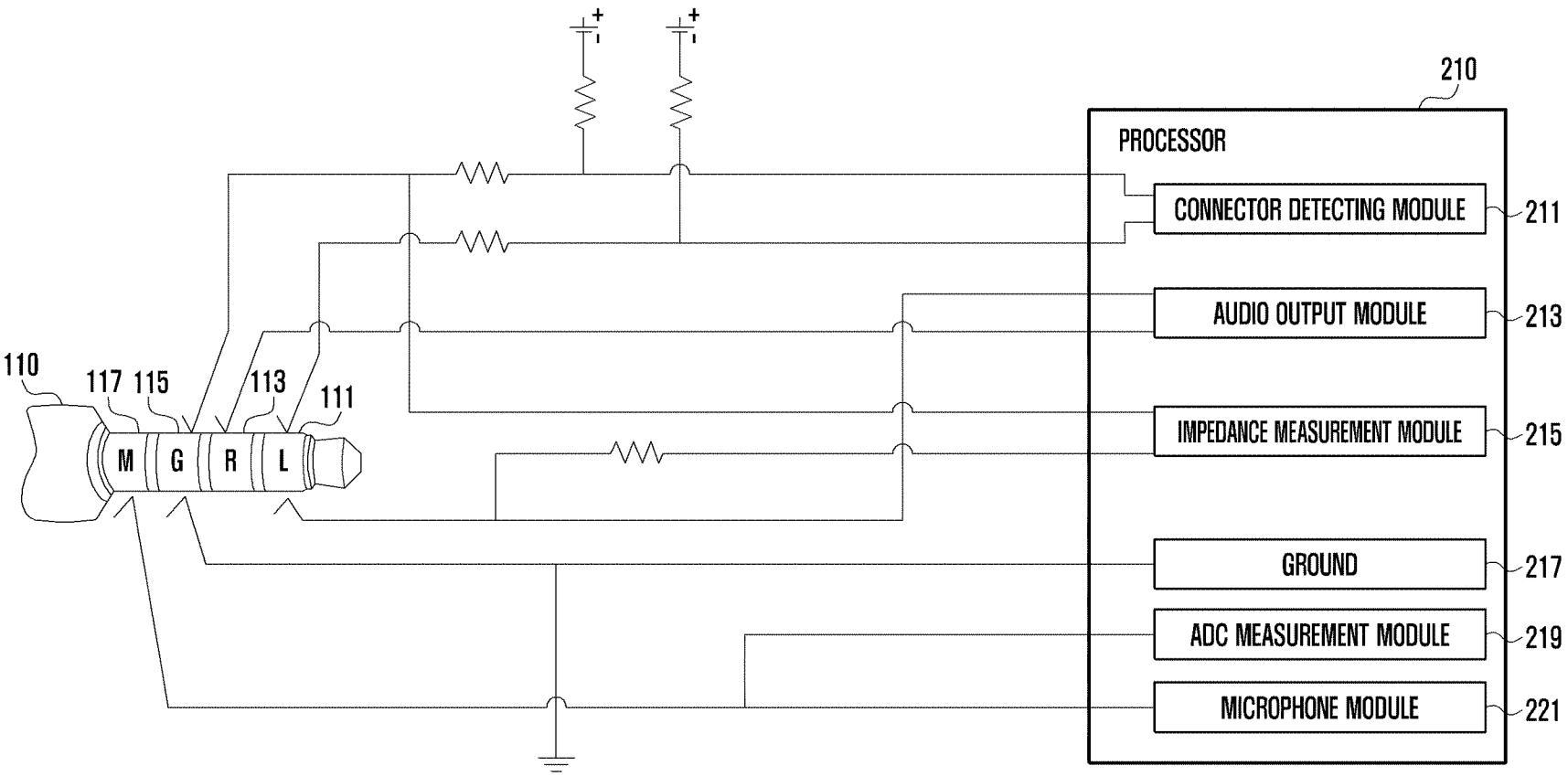

FIGS. 2A and 2B are circuit diagrams of an electronic device supporting an unbalanced-type connector, according to an embodiment of the present disclosure.

Referring to FIG. 2A, the electronic device connects with an unbalanced-type connector 110 and transmits/receives audio signals to/from the unbalanced-type connector 110. The processor 210 of the electronic device is configured to include a connector detecting module 211, an audio output module 213, an impedance measurement module 215, a ground 217, an analog-digital convertor (ADC) measurement module 219, and a microphone module 221. The processor 210 may be a specific processor, such as an audio codec. Although the embodiment is implemented in such a way that the modules are included in the processor 210, it should be understood that the present invention is not limited thereto. The modules may also be built in a particular area in the electronic device, not in the processor 210.

The connector detecting module 211 is connected to the TIP contact 111 and the RING2 contact 115 of the unbalanced-type connector 110 and determines whether the connector 110 is connected to the electronic device. Since electronic devices are generally configured to include a circuit for supporting the unbalanced-type connector 110, the connector detecting module 211 of the electronic device determines whether the unbalanced-type connector 110 is connected to the electronic device.

The audio output module 213 transmits R and L channel audio signals to the unbalanced-type connector 110 of an external output device, so that the external connector outputs the audio signals. Since the unbalanced-type connector 110 configures the contacts in order of LRGM signals, the audio output module 213 is connected to the TIP contact 111 corresponding to the L signal and the RING1 contact 113 corresponding to the R signal and transmits the audio signals thereto.

The impedance measurement module 215 measures an impedance of the connector connected to the electronic device. That is, the impedance measurement module 215 is connected to the TIP contact 111 and the RING2 115 contact of the connector connected to the electronic device and measures an impedance of the connector. When the electronic device is connected with a 3-conductor connector, the impedance measurement module 215 measures an impedance of the connector.

The ground 217 is connected to the RING2 contact 115 of the unbalanced-type connector 110 and grounds the unbalanced-type connector 110.

The ADC measurement module 219 is connected to the SLEEVE contact 117 of the unbalanced-type connector 110 and measures an ADC of the unbalanced-type connector 110. For example, the processor 210 measures an ADC of the unbalanced-type connector 110 via the ADC measurement module 219 and determines whether the SLEEVE contact 117 serves as a microphone contact. The processor 210 also identifies whether the connector connected to the electronic device is an unbalanced-type, based on the measured ADC value. The processor 210 may consider the measured ADC value to be an impedance of the connector connected to the electronic device.

The microphone module 221 is connected to the SLEEVE contact 117 of the unbalanced-type connector 110 and receives audio signals from a microphone of the external output device.

The electronic device is capable of supporting the unbalanced-type connector 110 as shown in FIG. 2A and connecting to the connector 110, forming a circuit, with electrical components, as shown in FIG. 2B. It should be understood that the present disclosure is not limited to the embodiment of the circuit shown in FIG. 2B.

Figure 3:
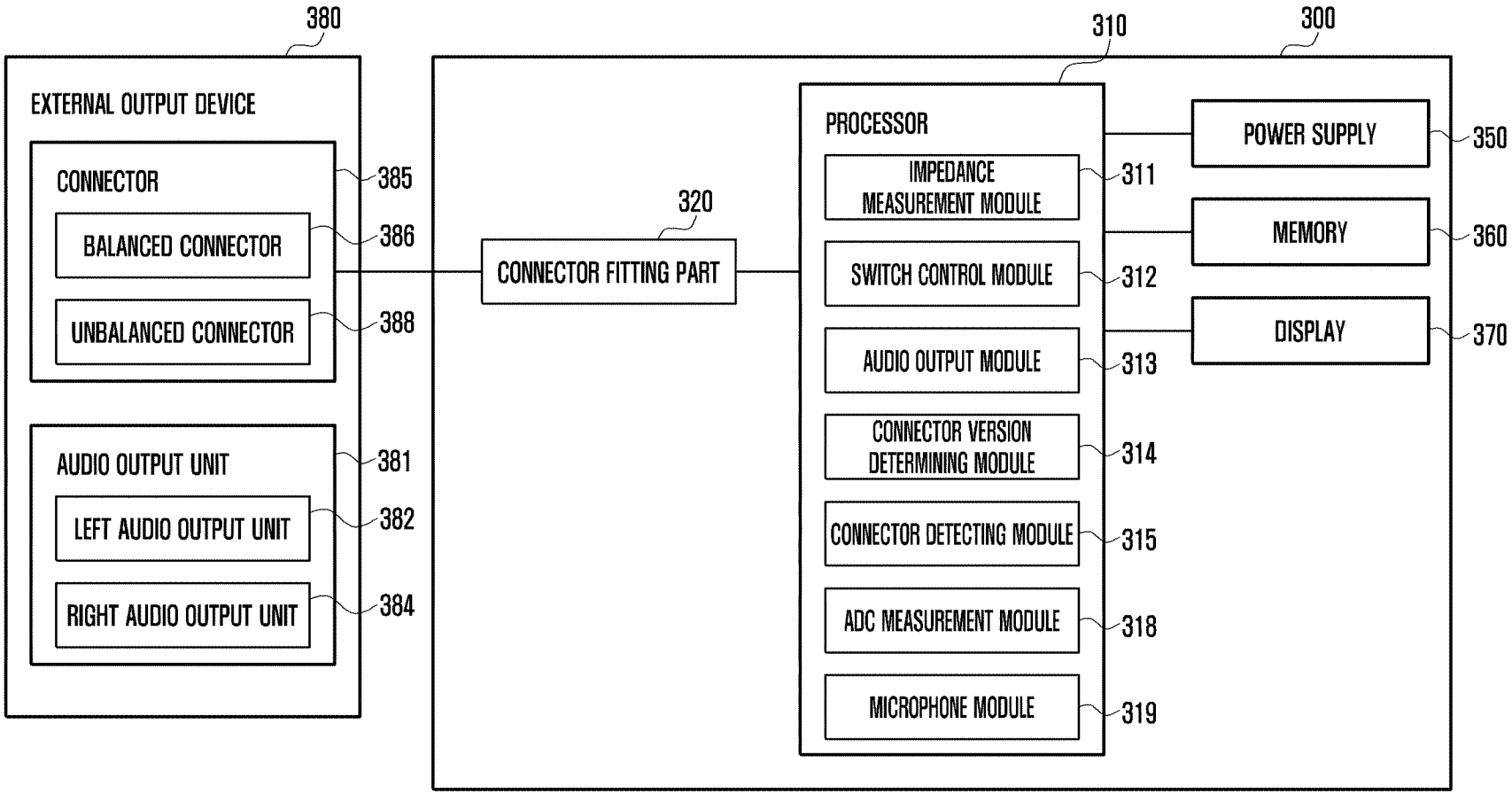
FIG. 3 is a block diagram of a balanced-type of electronic device, according to an embodiment of the present disclosure.

FIG. 3 is a block diagram of a balanced-type of electronic device, according to an embodiment of the present disclosure.

Referring to FIG. 3, an electronic device 300 is provided. The electronic device 300 includes a processor 310, a connector fitting part 320, a power supply 350, a memory 360, and a display 370. The electronic device 300 is connected to an external output device 380 (e.g., earphones, headsets, etc.) via the connector fitting part 320.

Although it is not shown, the components described above are connected to each other via a bus and the processor 310 transmits signals (e.g., control signals) to the components (e.g., the connector fitting part 320, power supply 350, memory 360, and display 370) to control them.

The processor 310 controls all the operations of the electronic device 300. For example, the processor 310 receives responses, via buses, from the components (e.g., the connector fitting part 320, power supply 350, memory 360, and display 370), analyzes the received responses, and performs operations or data processes according to the analyzed results.

The processor 310 includes an impedance measurement module 311, a switch control module 312, an audio output module 313, a connector version determining module 314, a connector detecting module 315, an ADC measurement module 318, and a microphone module 319. Although the embodiment shown in FIG. 3 is implemented in such a way that the processor 310 includes a connector version determining module 314 and a connector detecting module 315, it may be modified in such a way that the connector version determining module 314 and the connector detecting module 315 are installed in a component of the electronic device 300 other than the processor 310. In various embodiments of the present disclosure, the electronic device 300 may be implemented to include a connector identifying unit (which serves as the connector version determining module 314 and the connector detecting module 315) for detecting and identifying a connector, separate from the processor 310. In this case, the determination or identification of a connector is performed by the connector identifying unit, not by the processor 310. In the following description, the embodiments are described, assuming that the connector version determining module 314 and the connector detecting module 315 are included in the processor 310, but are not limited thereto.

The processor 310 controls operations of the individual modules therein. For example, the impedance measurement module 311 measures an impedance of the external output device 380 connected to the electronic device 300. When the processor 310 detects the external output device 380 via the connector fitting part 320, it controls the impedance measurement module 311 to measure an impedance of the connected, external output device 380. The impedance may be an impedance value of the left and right outputs of the external output device 380. The impedance may also be measured by the ADC measurement module 318. For example, the ADC measurement module 318 may measure an ADC value of the external output device 380. The ADC value may be a reference value to determine a version of the external output device 380 or an impedance of the external output device 380. That is, the processor 310 may also measure an impedance of the external output device 380 via the ADC measurement module 318.

The switch control module 312 controls a switch installed on the electronic device 300 under the control of the processor 310. The processor 310 may control the switch control module 312, based on the impedance of the external output device 380, measured by the impedance measurement module 311. For example, when the processor 310 ascertains that the external output device 380 is a balanced-type, based on the measured impedance of the external output device 380, it controls the switch control module 312 to alter the signal path in the circuit.

The audio output module 313 outputs, to the external output device 380, audio signals extracted from an audio file stored in the memory 360. The audio output module 313 outputs balanced-type audio signals and unbalanced-type audio signals. The processor 310 controls the audio output module 313 based on the version of the external output device 380 and determines a type of audio signals to be output.

The connector version determining module 314 identifies a version of the external output device 380 based on an impedance of the external output device 380, measured by the impedance measurement module 311. The version of the connector 385 may be used in the same sense as the version of the external output device 380. The connector version determining module 314 determines whether the external output device 380 is a balanced-type or unbalanced-type external output device.

When the connector of the external output device 380 is fitted (i.e., inserted, connected) to the connector fitting part 320, the connector detecting module 315 detects the external output device 380. The connector detecting module 315 is also capable of determining whether the connector of the external output device 380 is a 3-conductor connector or 4-conductor connector. The electronic device according to various embodiments of the present disclosure may also be implemented in such a way that it detects a 5-conductor connector of external output devices.

In various embodiments of the present disclosure, although the electronic device 300 is implemented in such a way that the processor 310 includes the connector version determining module 314 and the connector detecting module 315, it should be understood that the present disclosure is not limited thereto. The electronic device may also be implemented in such a way that the connector version determining module 314 and the connector detecting module 315 form a connector identifying unit, separate from the processor 310, and perform operations related to a connector.

The ADC measurement module 318 measures an ADC value of the external output device 380 connected to the electronic device 300. The ADC measurement module 318 is connected to a SLEEVE contact 117 of the connector 385 of the external output device 380 and measures an ADC value of the external output device 380 via the SLEEVE contact 117. The ADC value refers to a reference value to determine a version of the connector 385 of the external output device 380. For example, when the ADC value is zero, it indicates that the SLEEVE contact 117 of the connector 385 is grounded, or the version of the connector 385 is a 3-conductor connector. When the ADC value is greater than or equal to a pre-determined value, it indicates that the version of the connector 385 is a 4-conductor unbalanced connector. When the ADC value is a preset value within a pre-determined range, it indicates that the version of the connector 385 is a 4-conductor balanced connector. The measured ADC value may be an impedance of the external output device 380. The ADC measurement module 318 may perform part of the functions of the impedance measurement module 311. The connector version determining module 314 may also identify a version of the connector 385 of the external output device 380 based on an impedance measured by the ADC measurement module 318.

When the connector 385 of the external output device 380 is configured to include a microphone contact, the microphone module 319 receives an audio signal, such as voice signals, from a microphone of the external output device 380.

In various embodiments of the present disclosure, the electronic device 300 measures an ADC value of the external output device 380 via the ADC measurement module 318 and identifies a version of the connector 385 of the external output device 380, based on the measured ADC value.

The electronic device 300 includes a connector fitting part 320. The connector fitting part 320 is installed to the electronic device 300 so that it is connected with the connector 385 of the external output device 380. The connector fitting part 320 may be formed in one side of the electronic device 300 and shaped as a hole into which the connector 385 of the external output device 380 is fitted. The connector fitting part 320 is also referred to as a socket or a receptacle. The connector fitting part 320 may be configured in such a way to include contacts to support a 4-conductor unbalanced connector, corresponding to TIP, RING1, RING2, and SLEEVE contacts, thereby transmitting/receiving corresponding signals to/from the connector.

The electronic device 300 includes a power supply 350. The power supply 350 supplies power to the electronic device 300. The power supply 350 supplies power to the individual components therein under the control of the processor 310.

The electronic device 300 includes a memory 360. The memory 360 stores multi-media files therein. Examples of the multi-media file are audio files, music files, image files, video files, including a sound source, etc. The memory 360 refers to all types of storage devices capable of storing multi-media files containing a sound source, such as external memory devices, built-in memory devices, etc. The built-in memory (e.g., ROM, NAND, RAM, etc.) refers to memory devices which are capable of temporarily or permanently storing streaming files or downloaded file from networks. For example, the built-in memory may include one or more of the following: volatile memory, e.g., dynamic RAM (DRAM), static RAM (SRAM), synchronous dynamic RAM (SDRAM), etc.; non-volatile memory, e.g., one time programmable ROM (OTPROM), programmable ROM (PROM), erasable and programmable ROM (EPROM), electrically erasable and programmable ROM (EEPROM), mask ROM, flash ROM, NAND flash memory, NOR flash memory, etc. The external memory refers to memory devices formed to be fitted into electronic devices, such as trans-flash (T-flash), multimedia card (MMC), secure digital (SD) card, etc. For example, the external memory may further include flash drive, compact flash (CF), secure digital (SD), micro-secure digital (micro-SD), mini-secure digital (mini-SD), extreme digital (XD), a memory stick, etc. The external memory may be functionally connected to the electronic device 300 via various types of interface.

The electronic device 300 includes a display 370. The display 370 may include a panel, a hologram unit or a projector. The panel may be a liquid crystal display (LCD), an active matrix-organic light emitting diode (AM-OLED), or the like. The panel may be implemented to be flexible, transparent, or wearable. The panel may also be incorporated into one module together with a touch panel. The display 370 displays videos, images, etc., and also may sense a user's touch inputs. For example, the touch panel may recognize a touch input based on at least one of the following: capacitive, resistive, infrared, and ultrasonic modes. The display 370 may also display a User Interface (UI)/User Experience (UX) in various modes according to versions of the external output device 380.

The electronic device 300 is connected to the external output device 380 and outputs audio signals via the external output device 380.

The external output device 380 includes an audio output unit 381 and a connector 385. The audio output unit 381 refers to a part of earphones or headsets for outputting audio signals. The audio output unit 381 may be divided into a left audio output unit 382 corresponding to the left ear and a right audio output unit 384 corresponding to the right ear. The external output device 380 is connected to the electronic device 300 with the connector 385. The external output device 380 receives audio signals from the electronic device 300 via the connector 385. The connector 385 is classified, based on the configuration of the contacts, into a balanced connector 386 and an unbalanced connector 388. The external output device 380 of a balanced connector 386 is called a balanced-type external output device. Similarly, the external output device 380 of an unbalanced connector 388 is called an unbalanced-type external output device.

In various embodiments of the present disclosure, the electronic device includes a housing; an opening formed in one side of the housing; a hole communicating with the opening; a receptacle, placed inside the hole, for receiving one of first, second and third external connectors; and a circuit electrically connected to the receptacle. Each of the first and second connectors includes first number of contacts. The third external connector comprises a second number of contacts less than the first number of contacts. The circuit identifies which one of the first, second and third external connectors is inserted to the receptacle. When the first external connector is inserted to the receptacle, the circuit provides an audio output signal to the first external connector in a first manner. When the second external connector is inserted to the receptacle, the circuit provides an audio output signal to the second external connector in a second manner which differs from the first manner. When the third external connector is inserted to the receptacle, the circuit provides an audio output signal to the third external connector in a third manner which differs from the first and second manners.

In various embodiments, the first and second numbers are four and three, respectively.

In various embodiments, the first external connector is connected to an external audio device including first and second speakers, with a wire. When the first external connector is inserted to the receptacle, the circuit is configured to provide audio output signals to the first and second speakers via two of the first number of contacts of the first external connector. In addition, when the first external connector is inserted to the receptacle, the circuit is configured to receive audio output signals from the external audio device, via the two contacts and another contact from among the first number of contacts of the first external connector.

In various embodiments, the second external connector is connected to an external audio device including first and second speakers, with a wire. When the second external connector is inserted to the receptacle, the circuit provides a first audio output signal to the first speaker via two of the first number of contacts of the second external connector and a second audio output signal to the second speaker via two other contacts of the first number of contacts.

In various embodiments, the circuit includes a processor. The processor is configured to perform at least part of the identification operation and the audio output operation. In addition, the circuit measures voltage or impedance via at least part of the contacts of the first, second or third external connector inserted to the receptacle, and identifies a type of the external connector inserted to the receptacle, based on the measured voltage or impedance. When the first external connector is inserted to the receptacle, the circuit adjusts the audio output signal, based on the measured voltage or impedance, and provides the adjusted audio output signal to the first external connector. In addition, the circuit grounds a first one of the contacts of a first, second or third external connector inserted to the receptacle and identifies a type of the external connector inserted to the receptacle, based on the measured voltage or impedance, between the second one of the contacts and the ground.

Figure 4:
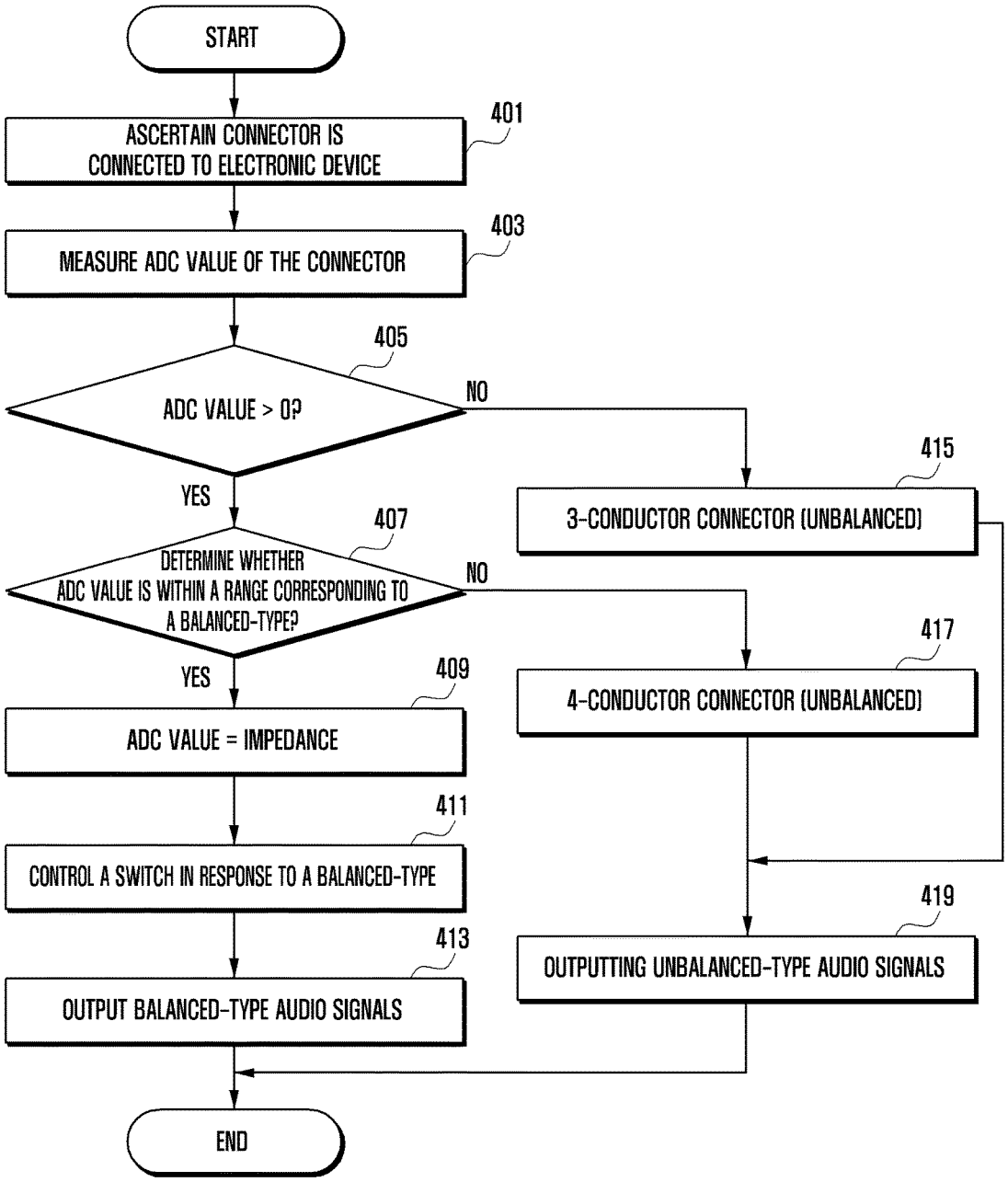
FIG. 4 is a flowchart of a method of an electronic device for supporting a connector of an external output device, according to an embodiment of the present disclosure.

FIG. 4 is a flowchart of a method of an electronic device for supporting a connector of an external output device, according to an embodiment of the present disclosure.

Referring to FIG. 4, the processor 310 of the electronic device 300 ascertains that the connector 385 is connected to the electronic device 300, via the connector detecting module 315, in step 401. The processor 310 measures an ADC value of the connector 385 in step 403. For example, the processor 310 supplies current to the connector 385 via the ADC measurement module 318 and measures an ADC value of the connector 385. The current supplied to the connector 385 is output from the power supply 350 of the electronic device 300.

The processor 310 determines whether the measured ADC value is greater than zero in step 405. When the measured ADC value is zero, the processor 310 ascertains that the connector 385 is a 3-conductor connector, in step 415. For example, a 3-conductor connector is configured to include three contacts which are arranged in order of LRG signals. With respect to a 4-conductor unbalanced connector, TIP contact 111 corresponds to L, the RING1 contact 113 corresponds to R, and the RING2 contact 115 and the SLEEVE contact 117 correspond to the G contact. Therefore, although the processor 310 supplies current via the SLEEVE contact 117 in order to measure an ADC value, since the SLEEVE contact 117 corresponds to the G contact, the ADC value may be zero.

When the processor 310 ascertains that the measured ADC value is greater than zero in step 405, it determines whether the measured ADC value is within a range corresponding to a balanced-type, in step 407. In the embodiment, the range corresponding to a balanced-type is 16~300Ω, but is not limited thereto. The range corresponding to a balanced-type may be a range of values stored in the memory 360. When the processor 310 ascertains that the ADC value is out of the range corresponding to a balanced-type in step 405, it considers the connector to be a 4-conductor unbalanced connector in step 417.

When the processor 310 ascertains that the measured ADC value is within a range corresponding to a balanced-type in step 407, it considers the connector to be a balanced-type connector. The processor 310 ascertains that the ADC value refers to an impedance of a balanced-type connector in step 409. That is, the processor 310 determines a level of output voltage of the external output device, based on the measured ADC value, in step 409.

The processor 310 controls a switch in response to a balanced-type in step 411. For example, the processor 310 may be configured to form a circuit corresponding to the LRGM (the standard of a 4-conductor unbalanced connector) in order to support an unbalanced-type external output device 380. When the processor 310 ascertains that the external output device 380 is a balanced-type via steps 401 to 409, it controls the switch control module 312 to operate the switch in the circuit. More specifically, the processor 310 controls the switch to break the connection between the RING2 contact 115 and the ground in the circuit configured in response to an unbalanced-type.

In various embodiments, the electronic device 300 is equipped with a switch placed between the RING2 contact 115 and the ground, and controls the switch to ground the RING2 contact 115. The electronic device 300 may be configured to form a circuitry to support a balanced-type external output device 380 when the connection between the RING2 contact 115 and the ground is open. That is, the electronic device 300 is capable of outputting audio signals via the RING2 contact 115 and the SLEEVE contact 117.

The processor 310 outputs balanced-type audio signals in step 413. Since the processor 310 controls the switch to connect the RING2 contact of the connector and the SLEEVE contact to a circuitry for outputting balanced-type audio signals in step 411, it outputs the balanced-type audio signals to the connector.

When the processor 310 ascertains that the connector is a 3-conductor connector (unbalanced) in step 415 or a 4-conductor connector (unbalanced) in step 417, it outputs unbalanced-type audio signals in step 419.

Figure 5:
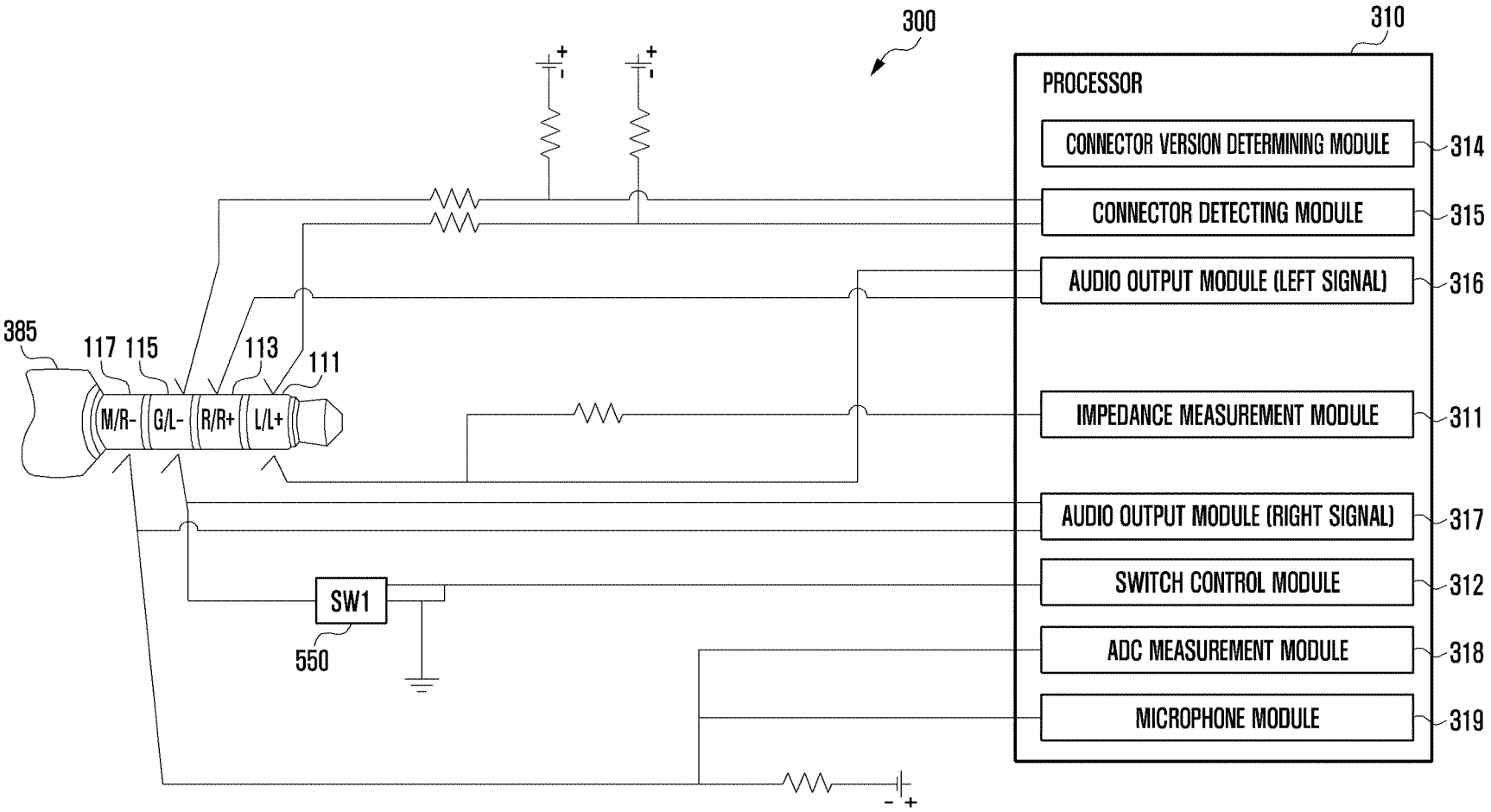
FIG. 5 is a circuit diagram of an electronic device supporting a balanced-type connector, according to an embodiment of the present disclosure.

FIG. 5 is a circuit diagram of an electronic device supporting a balanced-type connector, according to an embodiment of the present invention;

Referring to FIG. 5, the electronic device 300 is connected to a connector 385 of an external output device. The processor 310 of the electronic device 300 determines whether the connector 385 is connected to the electronic device 300 via the connector detecting module 315. The connector detecting module 315 is electrically connected to the TIP contact 111 and the RING2 contact 115 of the connector 385 and detects the connection of the connector 385. When the processor 310 ascertains that the connector 385 is connected to the electronic device 300, it measures an ADC value of the connector 385 via the ADC measurement module 318. The ADC measurement module 318 supplies current from the power supply 350 of the electronic device 300 to the connector 385, and measures an ADC value of the connector 385. The processor 310 identifies a type or version of the connector 385 based on the measured ADC value. The processor 310 may also measure an impedance of the connector 385 via the impedance measurement module 311.

In various embodiments of the present disclosure, the electronic device 300 may consider the ADC value, measured via the ADC measurement module 318, to be an impedance of the connector 385. That is, the electronic device 300 may identify a type (i.e., version) of the connector 385 based on the ADC value.

The processor 310 identifies whether the connector 385 is a balanced-type or an unbalanced-type, based on the measured ADC value and impedance. When the connector 385 is a balanced-type, the processor 310 controls the switch control module 312 to break the connection between the RING2 contact 115 and the ground. When the connector 385 is an balanced-type, the processor 310 controls the audio output module left signal 316 and audio output module right signal 317 to output balanced-type audio signals. The processor 310 may also adjust the output of audio signals, based on the measured ADC value and impedance. In addition, the processor 310 may receive audio signals from the connector 385 of the external output device 380 via the microphone module 319.

Table 1 provides impedances measured when the impedance of the external output device is "R" Ω.

TABLE 1

| | | 3-conductor (LRGG) | | 4-conductor (LRGM) | | Balanced_Output (L+, L−, R+, R−) | | |
|---|---|---|---|---|---|---|---|---|
| | Status | Not-inserted | Inserted | Not-inserted | Inserted | Not-inserted | Inserted | |
| 1 | TIP | H(high) | L(low) | H | L | H | L | 1.8 V_1M |
| 2 | RING2 | H | L | H | L | H | L | 1.8 V_1M |
| 3 | ADC(Ω) | L | 0 Ω | L | Impedance of MIC stage | L | R Ω | 2.8 V_2.2K |
| 4 | impedance | NA | R Ω | NA | R Ω | NA | OPEN | Unit impedance R |

Referring to Table 1, when the external output device is equipped with a 3-conductor connector (unbalanced), the ADC value is 0Ω; and the external output device is equipped with a 4-conductor unbalanced connector, 'impedance of MIC stage' is generally 1.35~33 KΩ That is, the processor 310 of the electronic device 300 measurers an ADC value of the external output device and identifies whether the connector of the external output device is a 3-conductor unbalanced connector or a 4-conductor unbalanced connector, based on the measured ADC value. When the measured ADC value is a preset impedance (RΩ)), the processor 310 considers the connector of an external output device to be a balanced-type. The preset impedance may be an impedance of the external output device, preferably, 16~300Ω.

Figure 6:
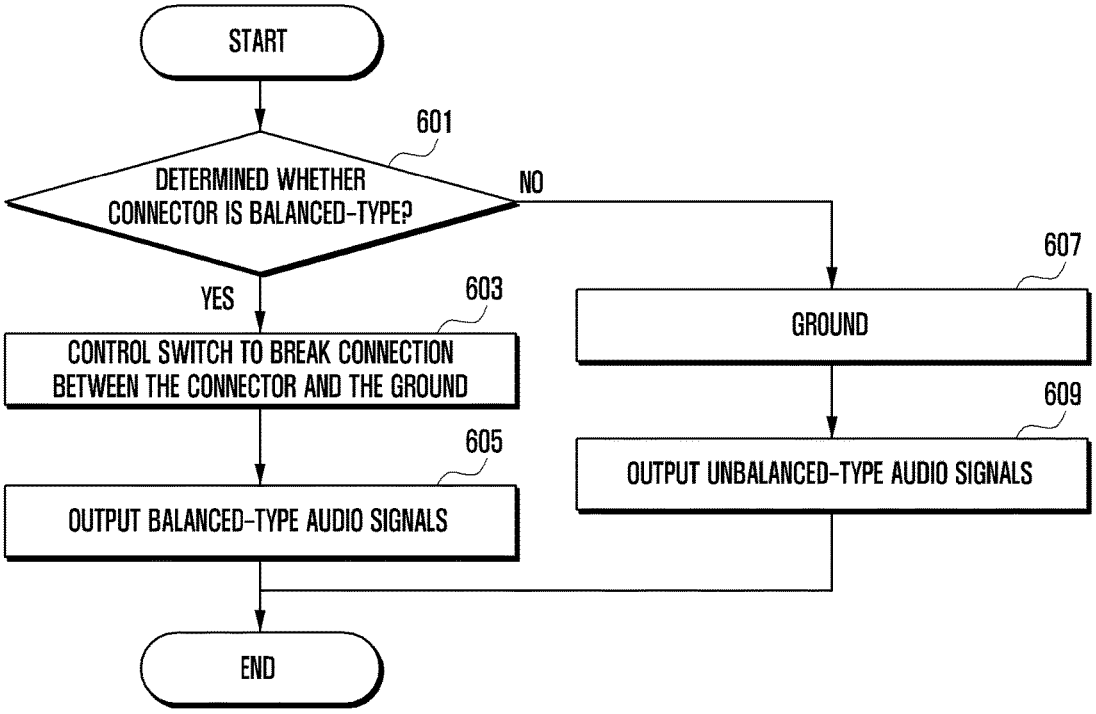
FIG. 6 is a flowchart of a method for supporting a balanced-type connector of an external output device, according to an embodiment of the present disclosure.

FIG. 6 is a flowchart of a method for supporting a balanced-type connector of an external output device, according to an embodiment of the present disclosure. FIG. 6 is a detailed flowchart that describes steps 407 to 413 of FIG. 4.

Referring to FIG. 6, the processor 310 determines whether the connector 385 of the external output device 380 is a balanced-type in step 601. The processor 310 measures an ADC value and an impedance of the external output device 380 and determines whether the connector 385 of the external output device 380 is a balanced-type, based on the measured ADC value and impedance. When the connector 385 is a balanced-type, it indicates that the external output device 385 can output balanced-type audio signals.

When the processor 310 ascertains that the connector 385 is a balanced-type in step 601, it controls the switch to break the connection between the connector 385 and the ground in step 603. That is, when the connector 385 is a balanced-type, the processor 310 controls the switch control module 312 to open the connection between the RING2 contact 115 of the connector 385 and the ground. For example, the electronic device 300 may be configured in such a way that the RING2 contact 115 of the connector 385 is electrically connected to the ground and a switch is placed between the RING2 contact 115 and the ground. When the processor 310 ascertains that the connector 385 is a balanced-type, it controls the switch to open the connection between the RING2 contact 115 and the ground. The processor 310 disconnects the connector 385 with the ground and simultaneously outputs balanced-type audio signals to the connector 385 via the RING2 contact 115. After that, the processor 310 outputs balanced-type audio signals in step 605.

On the other hand, when the processor 310 ascertains that the connector 385 is not a balanced-type in step 601, it indicates that connector 385 is grounded in step 607. To support an unbalanced-type connector, the electronic device 300 may be configured to ground the RING2 contact 115 of the connector. After that, the processor 310 outputs unbalanced-type audio signals in step 609.

Figure 7A:
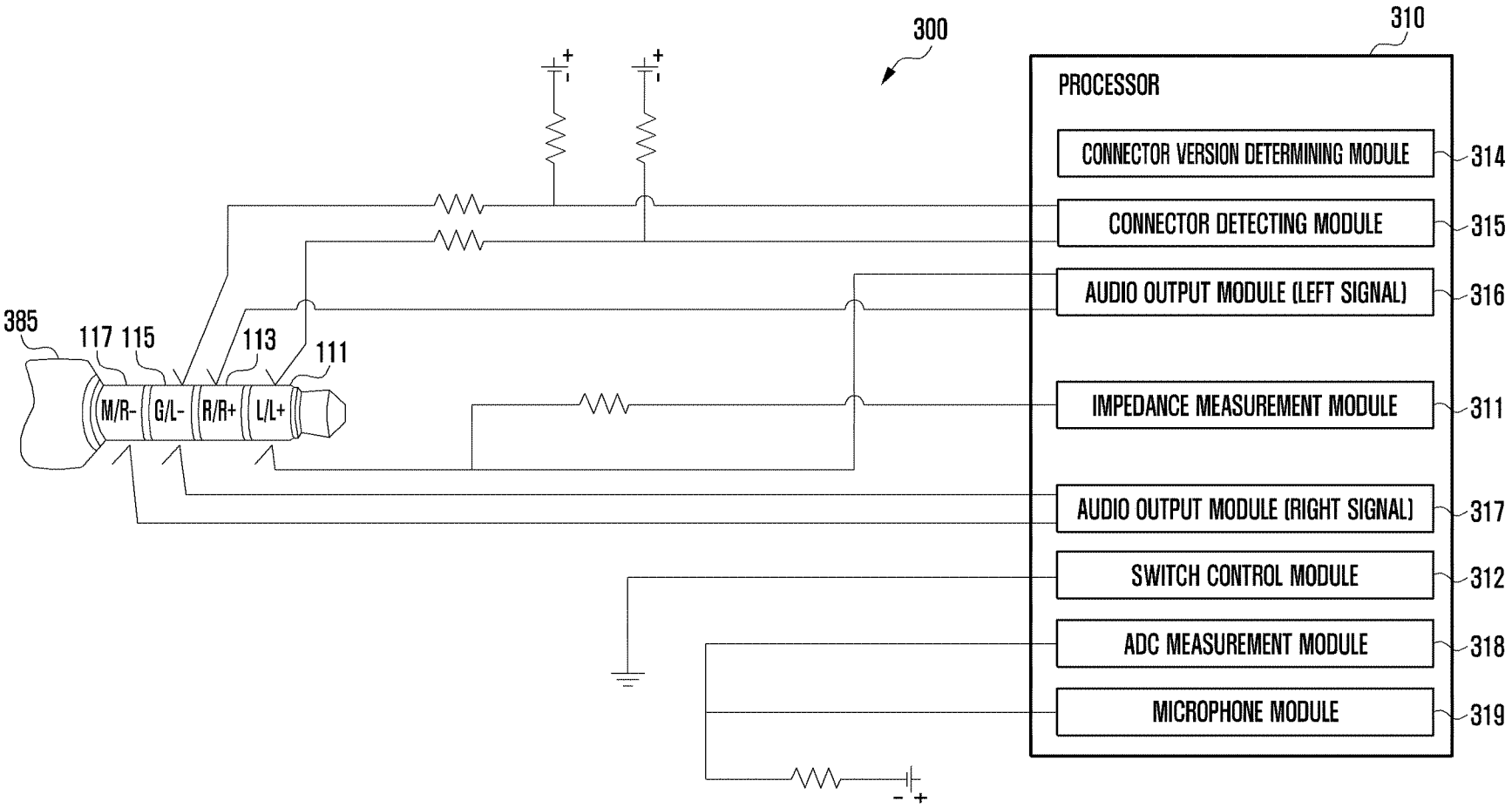
FIGS. 7A and 7B are circuit diagrams illustrate connections of a balanced-type connector and an unbalanced-type connector to an electronic device, respectively, according to an embodiment of the present disclosure.
Figure 7B:
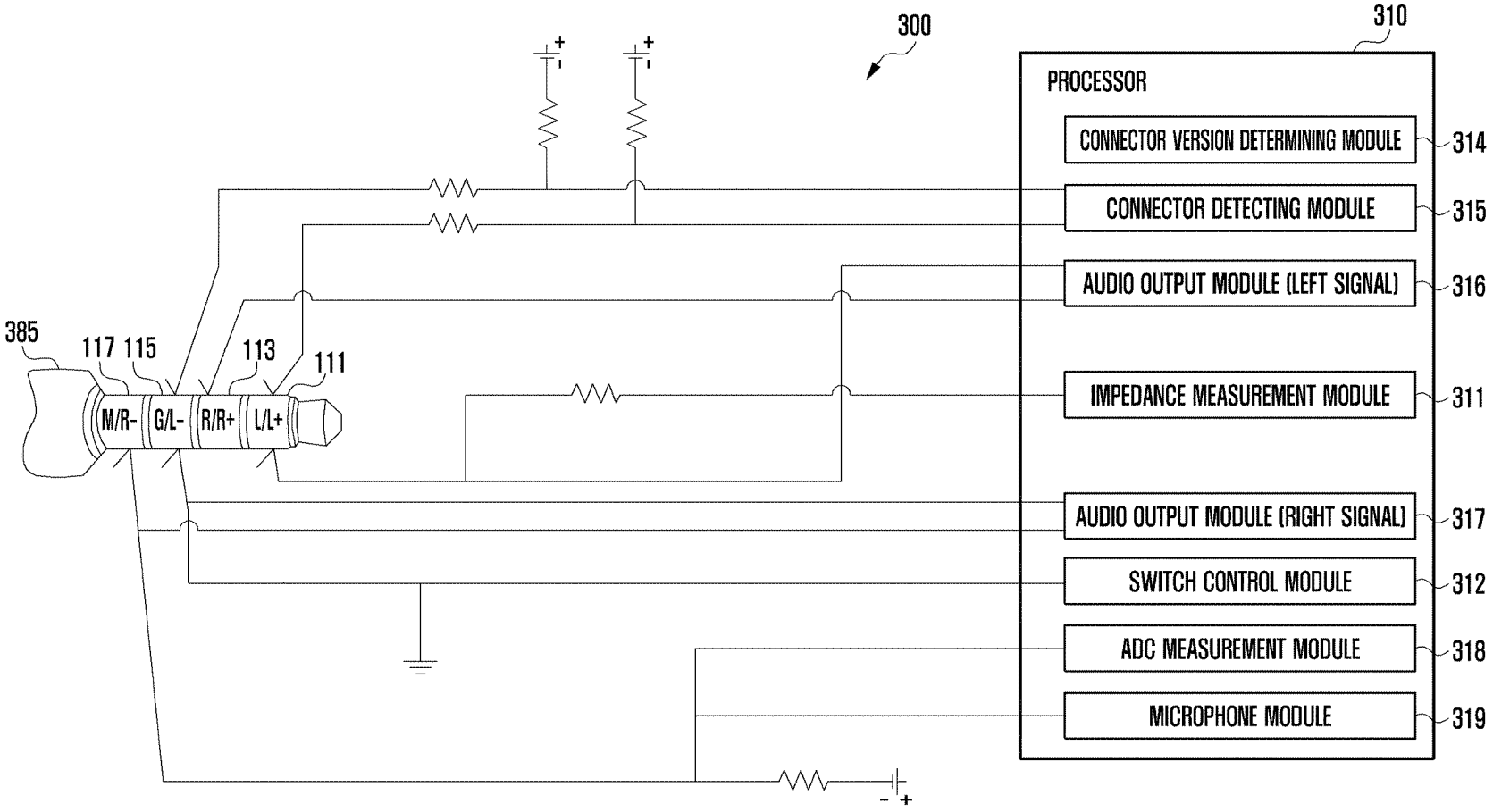

FIGS. 7A and 7B are circuit diagrams illustrate connections of a balanced-type connector and an unbalanced-type connector to an electronic device, respectively, according to an embodiment of the present disclosure. FIGS. 7A and 7B are circuit diagrams related to the steps of the flowchart shown in FIG. 6.

Referring to FIG. 7A, a circuit diagram when a balanced-type connector is connected to the electronic device 300 is provided. In comparison with the circuit diagram of shown in FIG. 5, the RING2 contact 115 of the connector is not grounded and the SLEEVE contact 117 is not connected to an ADC measurement module 318 and a microphone module 319. That is, when the electronic device is connected to a balanced-type connector, it does not ground the RING2 contact 115 of the connector and outputs balanced-type audio signals via the RING2 contact 115 and the SLEEVE contact 117.

Referring to FIG. 7B, a circuit diagram when an unbalanced-type connector is connected to the electronic device 300 is provided. The RING2 contact 115 is grounded and the SLEEVE contact 117 is connected to the ADC measurement module 318 and the microphone module 319. That is, when the electronic device is connected to an unbalanced-type connector, it outputs unbalanced-type audio signals via the TIP contact 111 and the RING1 contact 113 and uses a microphone function of the external output device via the SLEEVE contact 117.

Figure 7C:
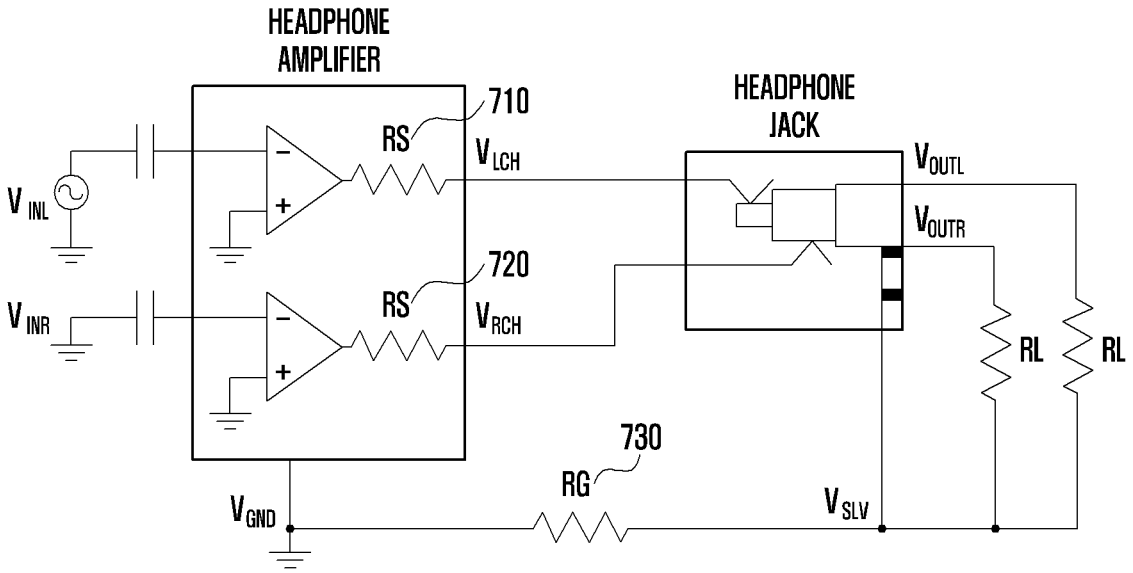
FIGS. 7C and 7D are circuit diagrams illustrating maintaining a switch resistance created by an additionally equipped switch, according to an embodiment of the present disclosure.
Figure 7D:
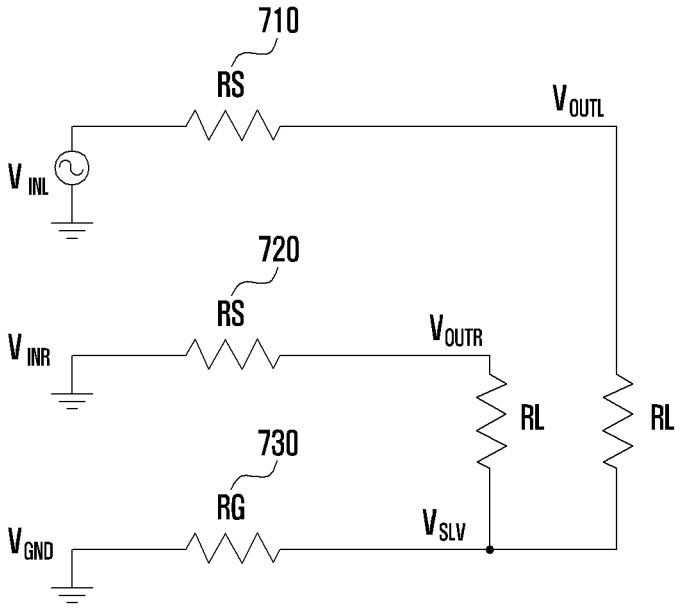

FIGS. 7C and 7D are circuit diagrams illustrating maintaining a switch resistance created by an additionally equipped switch, according to an embodiment of the present disclosure.

Referring to FIGS. 7C and 7D, the electronic device is equipped with a switch placed between the RING2 contact 115 of the connector and the ground, and it means that the electronic device has an additional resistance corresponding to the switch, i.e., a switch resistance. The added switch resistance affects the output of audio signals, e.g., crosstalk. Crosstalk is a phenomenon created as an electrical signal transmitted on a communication wire is electrically coupled with another communication wire, causing an undesired effect in the other communication wire. That is, crosstalk refers to an interference phenomenon caused by undesired energy from one circuit to another. Therefore, the electronic device needs to be compensated for an effect caused by the addition of the switch resistance.

Referring to FIG. 7C, a circuit diagram showing the connection between the electronic device and the external output device is provided. The electronic device adjusts a left resistance (Rs) 710 for the left audio signal and a right resistance (Rs) 720 for the right audio signal. The external output device has internal resistances RL and RG. In various embodiments, the electronic device adjusts the left resistance (Rs) 710 and the right resistance (RS) 720 and compensating for an effect caused by the switch resistance. Alternatively, the electronic device adjusts the internal resistances RL and RG of the external output device and compensating for an effect caused by the switch resistance.

Referring to FIG. 7D an equivalent circuit of the circuit shown in FIG. 7D is provided. As described above, crosstalk is caused by the switch resistance. A crosstalk is calculated by the following Equation (1).

$$\text{Crosstalk in dB} = 20\log\left(\frac{R_G}{R_L + R_S}\right) \tag{1}$$

Referring to Equation (1), the larger the RG value the more serious the crosstalk. For example, when an RG value increases by 0.1Ω, a crosstalk of approximately 5 dB is caused. In various embodiments, the electronic device minimizes the RG value and simultaneously compensates for the RS value, thereby reducing crosstalk.

When the electronic device is connected to an external output device, it detects an RG value, using a test signal. The electronic device varies impedance to a proper value via the codec or an external varistor. Therefore, the electronic device compensates for an effect caused by the switch resistance. That is, the electronic device is capable of minimizing the degradation caused by the addition of a switch.

Figure 7E:
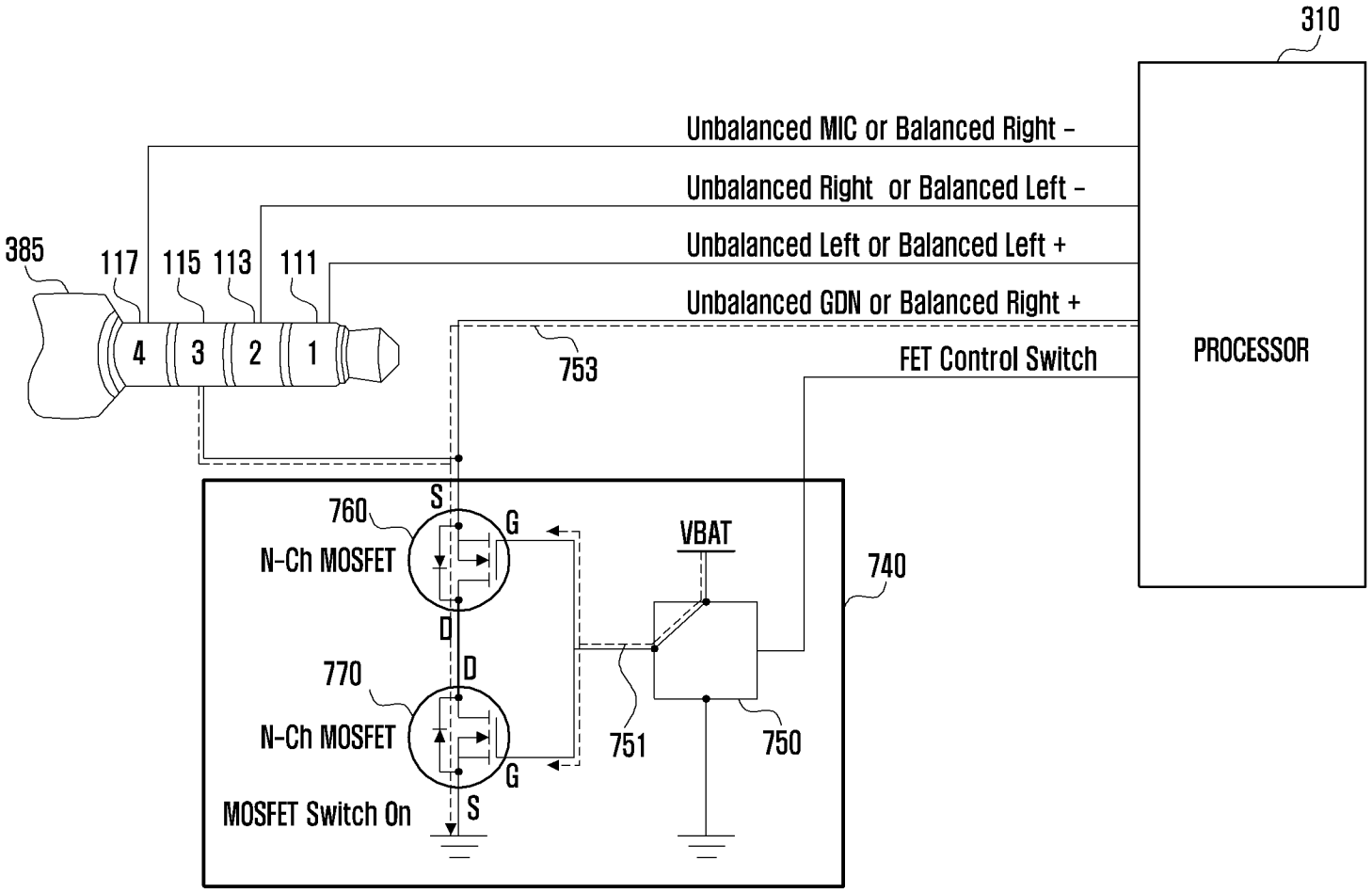
FIGS. 7E and 7F are diagrams illustrating a switch for minimizing a switch resistance, according to an embodiment of the present disclosure.
Figure 7F:
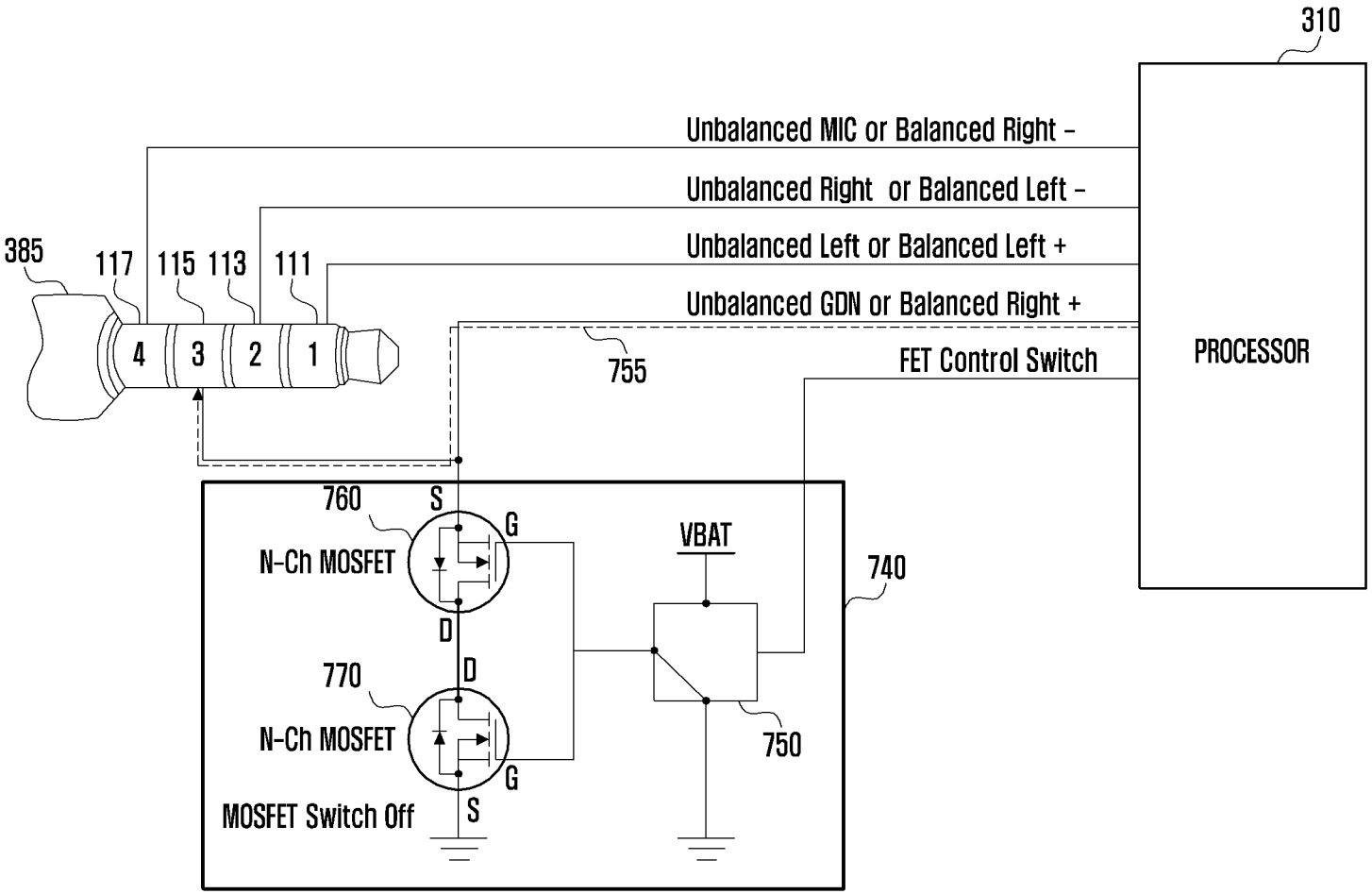

FIGS. 7E and 7F are diagrams illustrating a switch for minimizing a switch resistance, according to an embodiment of the present disclosure.

Referring to FIGS. 7E and 7F, the electronic device is capable of minimizing a switch resistance and also decreasing the performance degradation caused by crosstalk. For example, the electronic device may employ an N-ch MOSFET as a switching device.

Referring to FIG. 7E, the electronic device is capable of controlling the flow of signals, using a switching unit 740 including N-ch MOSFETs 760 and 770 and an FET GATE Controller 750. The FET GATE Controller 750 applies a voltage to the gates (G) of the two N-ch MOSFET 760 and 770 or grounds the gates to the ground (GND), under the control of the processor 310. Although the embodiment shown in FIG. 7E employs an FET GATE Controller 750, it should be understood that the present disclosure is not limited thereto. For example, the embodiment may also be implemented to employ an analog switch, a load switch, or the like. The switching unit 740 includes two N-ch MOSFETs 760 and 770, hereafter called a first MOSFET 760 and a second MOSFET 770, respectively. When the first MOSFET 760 and second MOSFET 770 receive voltage via the individual MOSFET GATEs (G), they are turned on. N-ch MOSFETs may have a smaller resistance $R_{SS}$ than P-ch MOSFETs.

The higher the level of voltage applied to the individual MOSFET GATEs (G) the lower the resistance value ($R_{SS}$). The switching unit 740 performs a switching function with a lower resistance than an analog audio switch. Although various embodiments of the present disclosure are configured in such a way that the switching unit 740 employs N-ch MOSFETs, it should be understood that the present disclosure is not limited thereto.

FIG. 7E illustrates a state where the switching unit 740 is turned on, supporting an unbalanced-type external output device. The processor 310 controls the FET of the switching unit 740 and applies a voltage VBAT to the gates (G) of the first MOSFET 760 and the second MOSFET 770. The voltage VBAT is applied to the component along the dashed line 751. When the first MOSFET 760 and the second MOSFET 770 receive the voltage VBAT via the individual gates (G), they are turned on to allow electrical signals to flow through themselves. That is, the source (S) of the second 2 MOSFET is grounded, thereby grounding the RING2 contact 115 of the external output device connector 385. When the switching unit 740 is turned on, an electrical signal is transmitted along the dashed line 753. In various embodiments of the present disclosure, the electronic device is capable of supporting the unbalanced-type external output device, using the switching unit 740.

Referring to FIG. 7F, the electronic device is capable of supporting the balanced-type external output device, using the switching unit 740. FIG. 7F illustrates a state where the switching unit 740 is turned off, supporting a balanced-type external output device. The processor 310 controls the switching unit 740 and grounds the individual gates (G) of the first MOSFET 760 and the second MOSFET 770. When the individual gates (G) of the first MOSFET 760 and the second MOSFET 770 are grounded, the 1 MOSFET 760 and the second MOSFET 770 are turned off, not allowing electrical signals to flow. That is, the RING2 contact 115 of the external output device connector 385 is not grounded but receives an R+ signal. When the switching unit 740 is turned off, an electric signal flows along the dashed line 755. In various embodiments of the present disclosure, the electronic device is capable of supporting the balanced-type external output device, using the switching unit 740.

The electronic device according to various embodiments of the present disclosure may be implemented to employ the switching unit 740, instead of an analog switch. In this case, the electronic device may remove a degradation phenomenon caused by a resistance of an analog switch.

Figure 8:
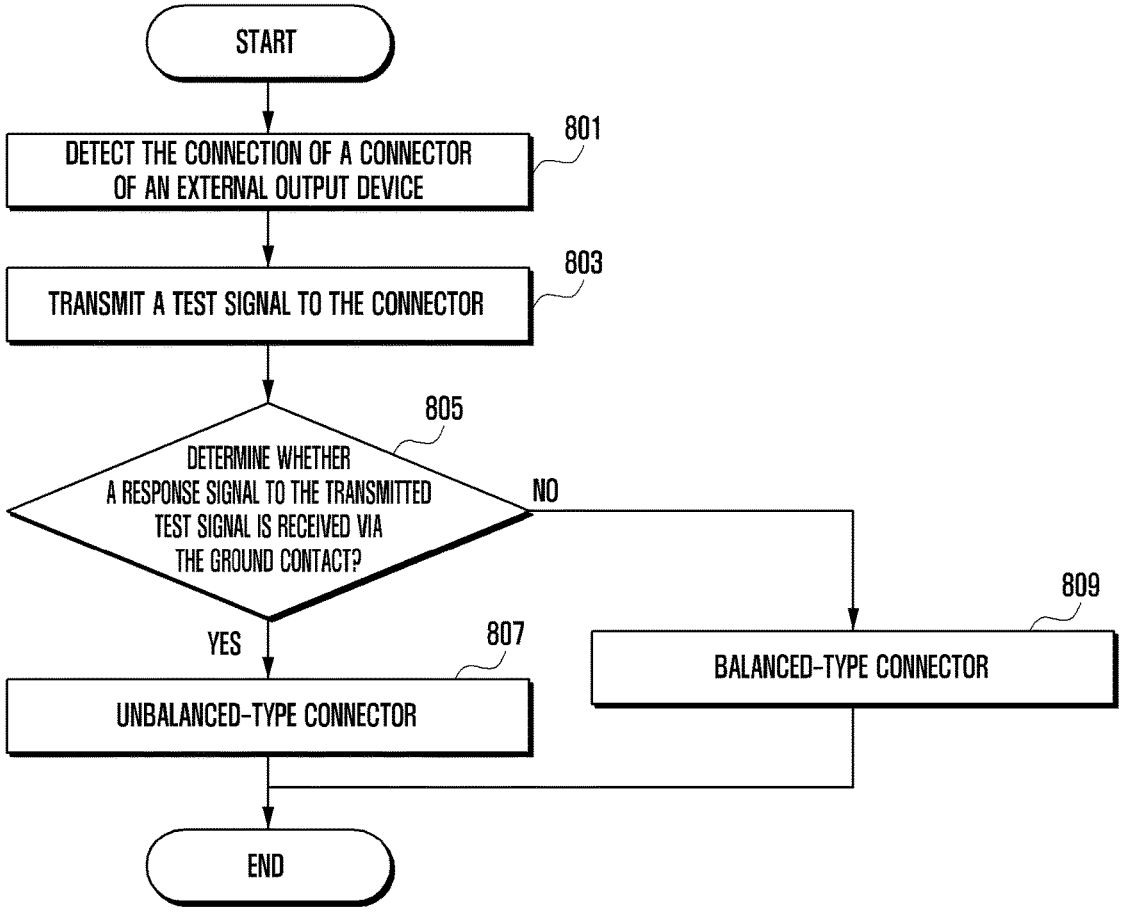
FIG. 8 is a flowchart of a method for using a test signal to identify a type of external output device, according to an embodiment of the present disclosure.

FIG. 8 is a flowchart of a method for using a test signal to identify a type of external output device, according to an embodiment of the present disclosure.

Referring to FIG. 8, when an external output device is connected to the electronic device, the electronic device identifies a type of external output device (e.g., balanced-type, unbalanced-type), using a test signal. For example, when an unbalanced-type external output device is connected to the electronic device, the electronic device connects the RING2 contact of the unbalanced-type connector to the ground. In this case, the unbalanced-type audio signal is transmitted to the external output device via the TIP contact and RING1 contact, and the electronic device receives the response signal (e.g., feedback signal) via the grounded, RING2 contact. In contrast, when the balanced-type external output device is connected to the electronic device, the electronic device may break the connection between the RING2 contact of the balanced-type connector and the ground (i.e., open). The balanced-type audio signal is transmitted to the external output device, via the TIP, RING1, RING2, and SLEEVE contacts of the connector. That is, the electronic device supporting balanced-type connectors does not receive a response signal corresponding to a signal of the ground contact.

Based on the operations described above, the electronic device identifies a type of external output device using a test signal. The processor 310 detects the connection of a connector of an external output device in step 801. The processor 310 transmits, to the external output device, a test signal along with audio signals in step 803. The processor 310 determines whether a response signal to the transmitted test signal is received via the ground contact in step 805. When the processor 310 ascertains that a response signal is received in step 805, it identifies that the connected, external output device is an unbalanced-type in step 807. Therefore, the processor 310 transmits an unbalanced-type audio signal to the external output device. On the other hand, when the processor 310 ascertains that a response signal is not received in step 805, it identifies that the connected, external output device is a balanced-type in step 809. Therefore, the processor 310 transmits a balanced-type audio signal to the external output device.

Figure 9A:
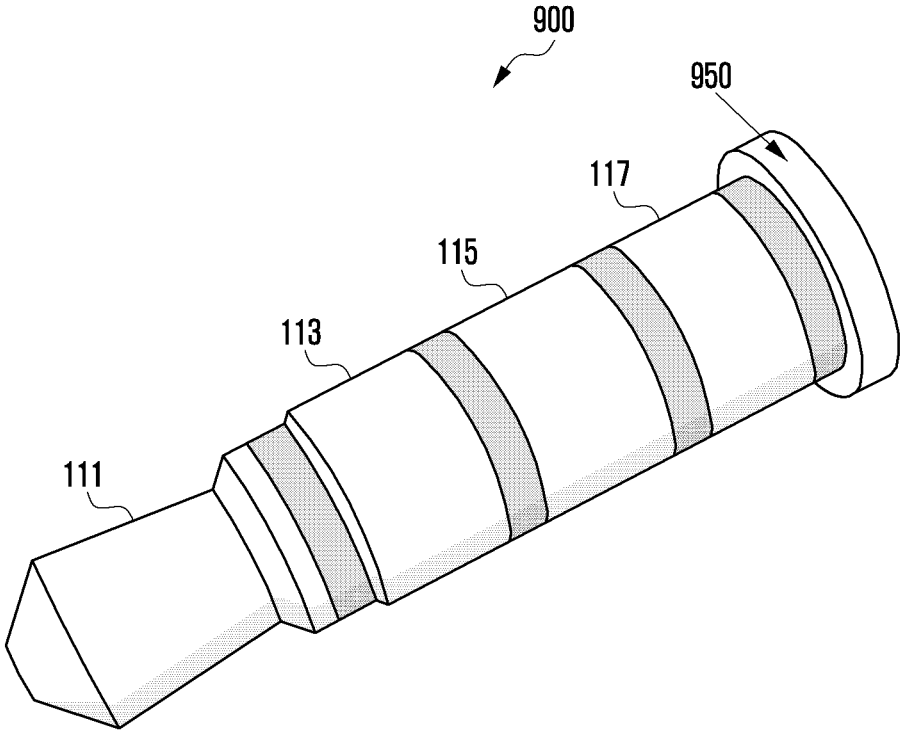
FIG. 9A illustrates a 5-conductor connector, according to an embodiment of the present disclosure
Figure 9B:
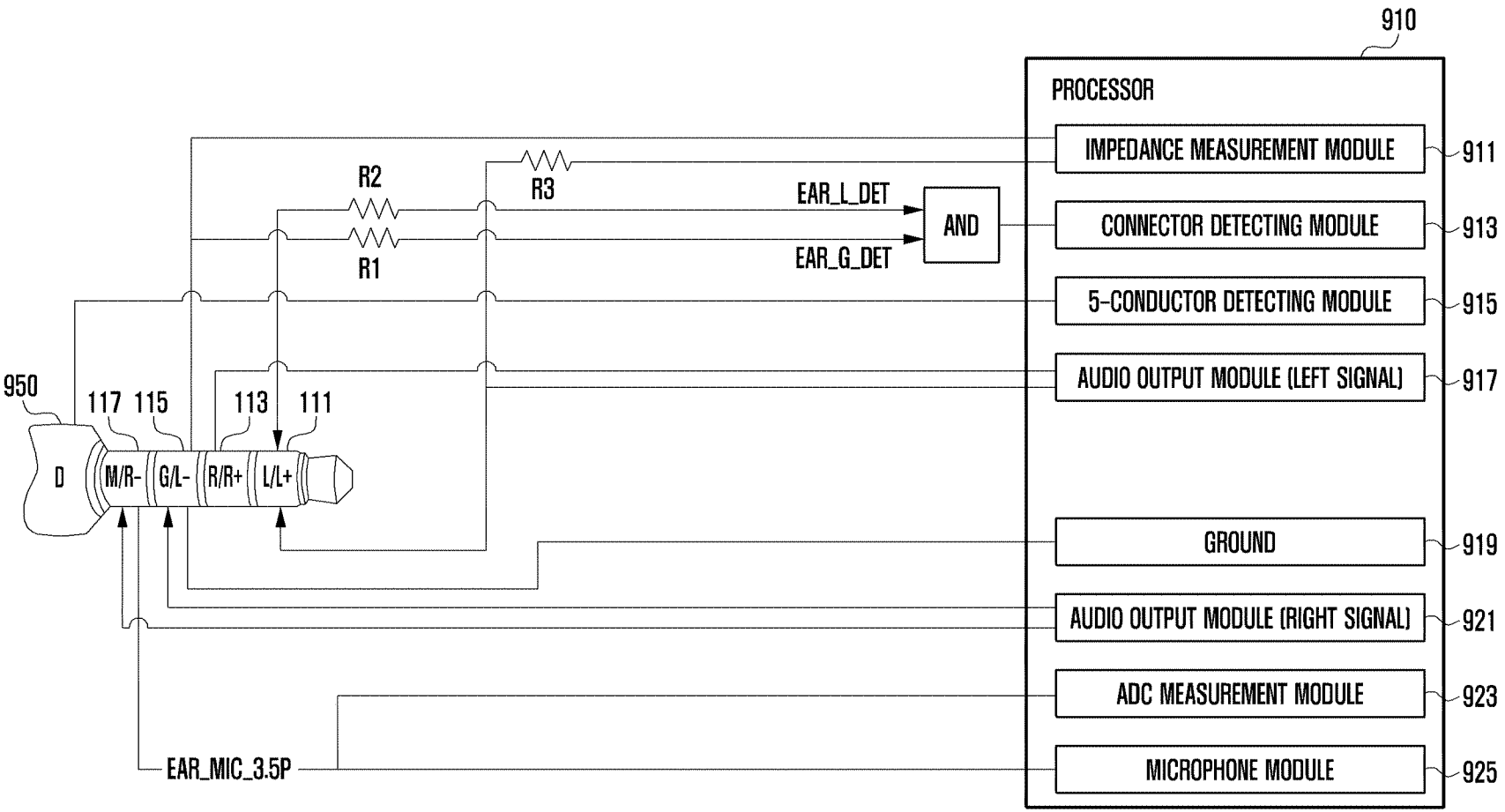
FIG. 9B is a diagram of a circuit for supporting a 5-conductor connector, according to an embodiment of the present disclosure.

FIG. 9A illustrates a 5-conductor connector, according to an embodiment of the present disclosure. FIG. 9B is a diagram of a circuit for supporting a 5-conductor connector, according to an embodiment of the present disclosure.

Referring to FIG. 9A, the 5-conductor connector 900 includes five contacts configured as one of them, a fifth contact, is further added to a 4-conductor connector of four contacts. For example, the 5-conductor connector 900 may be configured to further include a fifth contact 950 in addition to the four contacts of general 4-conductor connectors, in such a way that the fifth contact 950 is added to a place following the SLEEVE contact 117 but electrically disconnected from the SLEEVE contact 117. Since the 5-conductor connector 900 includes an addition fifth contact 950 and the four existing contacts (TIP, RING1, RING2, and SLEEVE), it may ground the fifth contact 950 to be used for additional functions, while outputting a balanced-type audio signal via the contacts. In various embodiments, the 5-conductor connector 900 may be configured in such a way that the fifth contact 950 is connected to a microphone, etc. It should be understood that the connection of the fifth contact 950 is not limited to the embodiments shown in FIG. 9A. For example, when the 5-conductor connector 900 sets the fifth contact 950 for a microphone, it can perform a microphone function via the fifth contact 950 and simultaneously output a balanced-type audio signal via the four remaining contacts.

Referring to FIG. 9B, in an electronic device supporting a 5-conductor connector 900, the processor 910 may include a 5-conductor detecting module 915 for detecting the insertion (or connection) of a 5-conductor connector 900. The processor 910 determines whether a connector connected to the electronic device is a 5-conductor connector 900, via the 5-conductor detecting module 915.

In various embodiments, the electronic device may also identify a type (version) of connector, based on a condition as to whether a connector connected to the electronic device is a 5-conductor connector. For example, when a 5-conductor connector is set as a balanced-type connector, the processor 910 determines whether a connector is a 5-conductor connector, via the 5-conductor detecting module 915. When the processor 910 ascertains that a connector is a 5-conductor connector, it identifies that the connector is a balanced-type connector.

As shown in FIG. 9B, the processor 910 is configured to include the same components as the processor 310 of FIG. 5, in addition to a 5-conductor detecting module 915. The components of the processor 910 perform the same functions as those of the processor 310 shown in FIG. 5. A detailed description regarding them is omitted in this section.

Figure 10A:
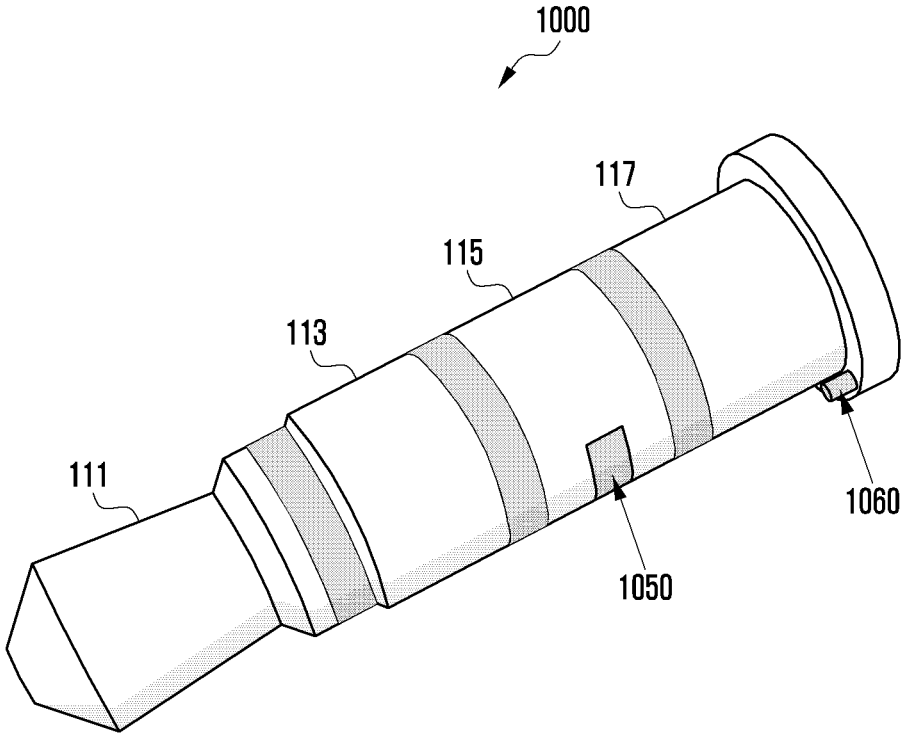
FIG. 10A illustrates a 5-conductor connector, according to an embodiment of the present disclosure.
Figure 10B:
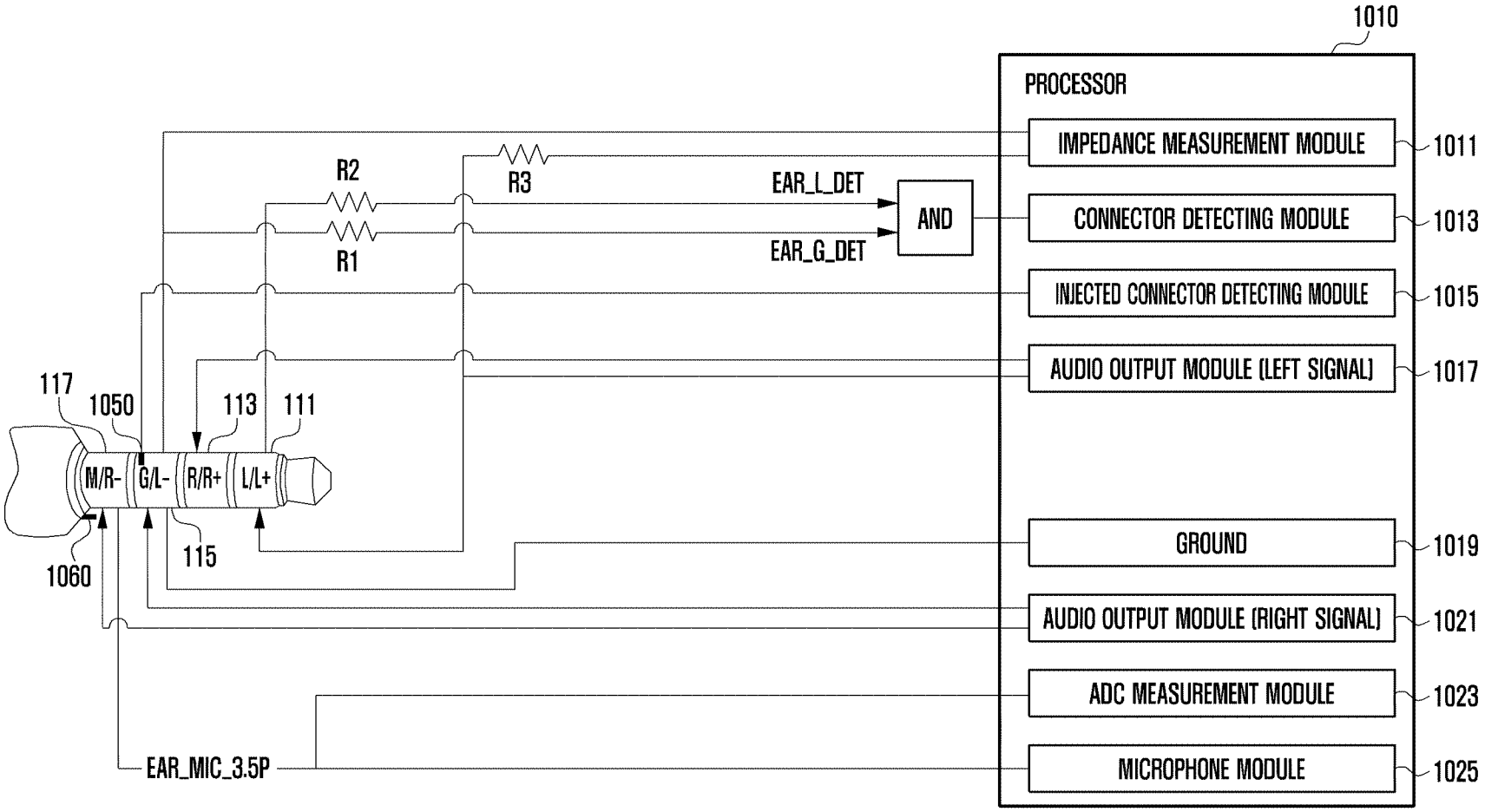
FIG. 10B is a diagram of a circuit for supporting a 5-conductor connector, according to an embodiment of the present disclosure.

FIG. 10A illustrates a 5-conductor connector, according to an embodiment of the present disclosure. FIG. 10B is a diagram of a circuit for supporting a 5-conductor connector, according to an embodiment of the present disclosure.

Referring to FIG. 10A, the 5-conductor connector is configured in such a way as to include contacts (e.g., TIP, RING1, RING2, and SLEEVE) configured as in a 4-conductor connector and an injected object 1050 added to one of the contacts of the 4-conductor connector so that the piece is electrically isolated from the contact. Therefore, the 5-conductor connector is distinguished from existing 4-conductor connectors. In this configuration, the 5-conductor connecter including the injected object 1050 is referred to as an injected connector 1000. Although the embodiment shown in FIG. 10A is implemented in such a way that the injected object 1050 is added to the RING2 contact 115 of an existing 4-conductor connector, it should be understood that the present disclosure is not limited thereto. Since the injected connector 1000 is implemented in such a way as to add an injected object 1050 to a particular contact of an existing 4-conductor connector, it needs a marker 1060 to detect a precise location of the injected object 1050. The marker 1060 prevents the injected connector 1000 from being rotated and provides the electronic device with the precise location of the injected object 1050. In order to meet the structure of the injected connector 1000, the connector fitting part of the electronic device may also be configured to form a structure for coupling with the maker 1060.

Referring to FIG. 10B, an electronic device configured to support an injected connector includes a connector fitting part configured to couple with the marker 1060 of the injected connector 1000, and also an injected connector detecting module 1015 for detecting the insertion (or connection) of the injected object 1050.

In various embodiments, the electronic device may determine whether a connector connected to the electronic device is an injected connector and identify, based on the determination, whether the connector is a balanced-type or an unbalanced-type. For example, when the injected connector has been set as a balanced-type connector, the processor 1010 determines whether the connector is an injected connector via the injected connector detecting module 1015. When the processor 1010 ascertains that the connector is an injected connector, it also identifies that the connector is a balanced-type connector.

As shown in FIG. 10B, the processor 1010 is configured to include the same components as the processor 310 of FIG. 5, in addition to the injected connector detecting module 1015. The components of the processor 1010 perform the same functions as those of the processor 310 shown in FIG. 5. A detailed description regarding them is omitted in this section.

Figure 11A:
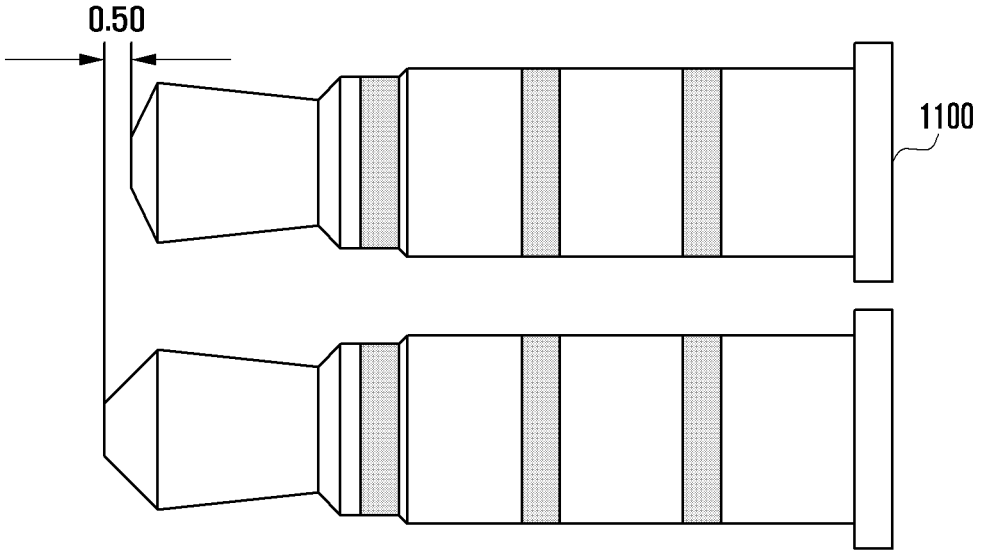
FIGS. 11A and 11B are a diagram showing connectors that differ in length from each other and a diagram showing a circuit for determining and supporting a type of connector based the length, according to an embodiment of the present disclosure.
Figure 11B:
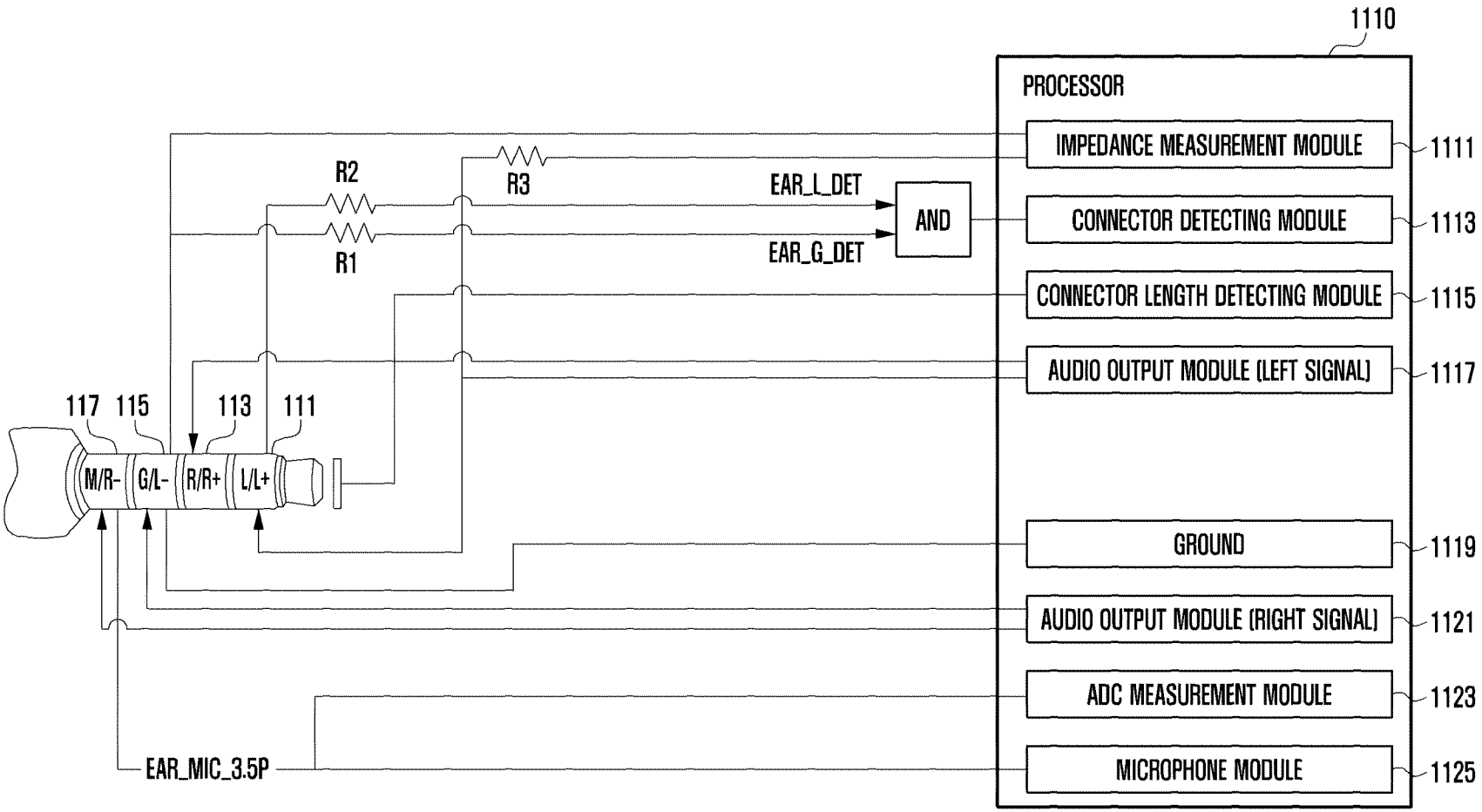

FIGS. 11A and 11B are a diagram showing connectors that differ in length from each other and a diagram showing a circuit for determining and supporting a type of connector based the length, according to an embodiment of the present disclosure.

FIG. 11A is a diagram showing a short 4-conductor connector 1100 implemented as an existing 4-conductor connector with a shortened TIP contact. In the following description, a 4-conductor connector 1100 with a shorter TIP contact than an existing 4-conductor connector is also called a short 4-conductor connector. In the embodiment shown in FIG. 11A, the short 4-conductor connector 1100 is shorter by 0.5 cm than an existing 4-conductor connector. It should be understood that 0.5 cm is only an example of the difference in length between the short 4-conductor connector 1100 and the existing 4-conductor connector and the present disclosure is not limited to 0.5 cm. The short 4-conductor connector 1100 is distinguished from existing 4-conductor connectors, based on the difference in length between contacts.

FIG. 11B is a diagram showing a circuit of an electronic device configured to support a short 4-conductor connector 1100. The processor 1110 of the electronic device includes a connector length detecting module 1115 for detecting the insertion (or connection) of a short 4-conductor connector 1100. The processor 1110 is capable of determining whether the connector is a short 4-conductor connector 1100, via the connector length detecting module 1115.

In various embodiments, the electronic device may determine whether a connector connected to the electronic device is a short 4-conductor connector 1100 and identify a type of connector based on the determination. For example, when the short 4-conductor connector 1100 has been set as a balanced-type connector, the processor 1110 determines whether the connector is a short 4-conductor connector 1100 via the connector length detecting module 1115. When the processor 1110 ascertains that the connector is a short 4-conductor connector 1100, it is also capable of identifying that the connector is a balanced-type connector. The embodiment shown in FIG. 11B is a circuit to support a short 4-conductor connector 1100.

As shown in FIG. 11B, the processor 1110 is configured to include the same components as the processor 310 of FIG. 5, in addition to the connector length detecting module 1115. The components of the processor 1110 perform the same functions as those of the processor 310 shown in FIG. 5. A detailed description regarding them is omitted in this section.

Figure 12:
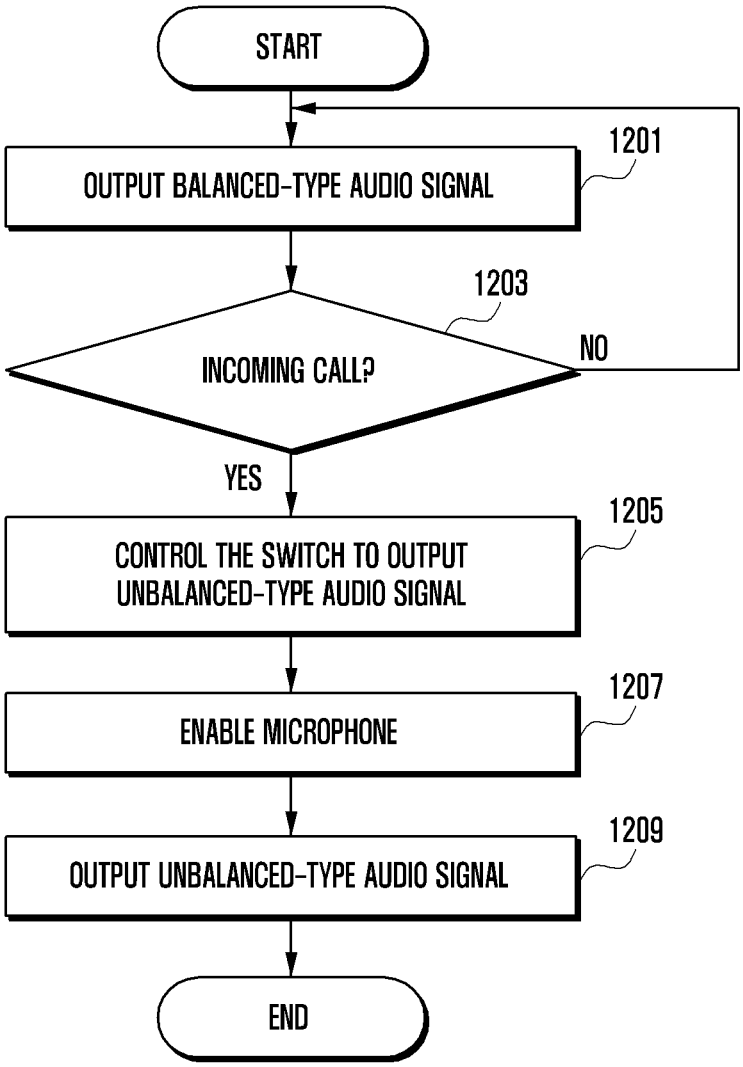
FIG. 12 is a flowchart of a method for changing operations for supporting a connector from a balanced-type to an unbalanced-type when receiving a phone call while supporting the balanced-type connector, according to an embodiment of the present disclosure.

FIG. 12 is a flowchart of a method for changing operations for supporting a connector from a balanced-type to an unbalanced-type when receiving a phone call while supporting the balanced-type connector, according to an embodiment of the present disclosure.

In order to output a balanced-type audio signal, the electronic device needs to transmit four signals (e.g., L+, L−, R+, and R−) to an external output device. When a 4-conductor connector connected to the electronic device is configured as a balanced-type, the electronic device may not support a microphone. In various embodiments, when the electronic device receives an incoming call while outputting a balanced-type audio signal, it alters the audio signal output mode from a balanced-type to an unbalanced-type, thereby providing a microphone function to the user.

Referring to FIG. 12, the processor of the electronic device outputs a balanced-type audio signal in step 1201. For example, the processor may transmit L+, L−, R+, and R− signals to a connector of an external output device. The processor determines whether it receives an incoming call in step 1203. When the processor receives an incoming call in step 1203, it controls the switch to output an unbalanced-type audio signal in step 1205. That is, the processor receives an incoming call and alters the audio signal output mode from a balanced-type to an unbalanced-type. For example, the processor controls the switch to alter the configuration of the circuit electrically connected to a connector of an external output device, for outputting audio signals in order from L+, L−, R+, and R− to L, R, G (ground), and M (microphone). When the processor controls the switch to output an unbalanced-type audio signal, the microphone is enabled in step 1207. The processor outputs an unbalanced-type audio signal in step 1209.

When the electronic device alters the audio signal outputting mode from a balanced-type to an unbalanced-type, the external output device also needs to alter the audio signal outputting mode to the same as the electronic device (i.e., from a balanced-type to an unbalanced-type). A detailed circuit of the external output device is described referring to FIGS. 13A and 13B.

Figure 13A:
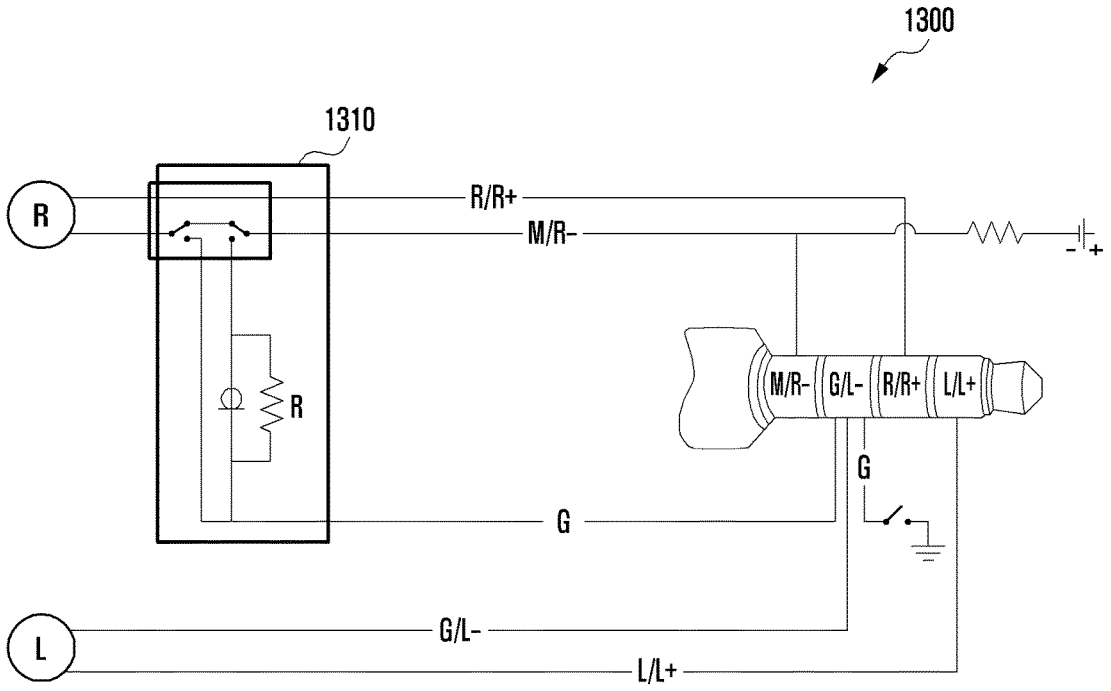
FIGS. 13A and 13B are diagrams showing circuits that describe operations to change from a balanced-type connector supporting mode to an unbalanced-type connector, when a phone call is received while supporting the balanced-type connector according to an embodiment of the present disclosure.
Figure 13B:
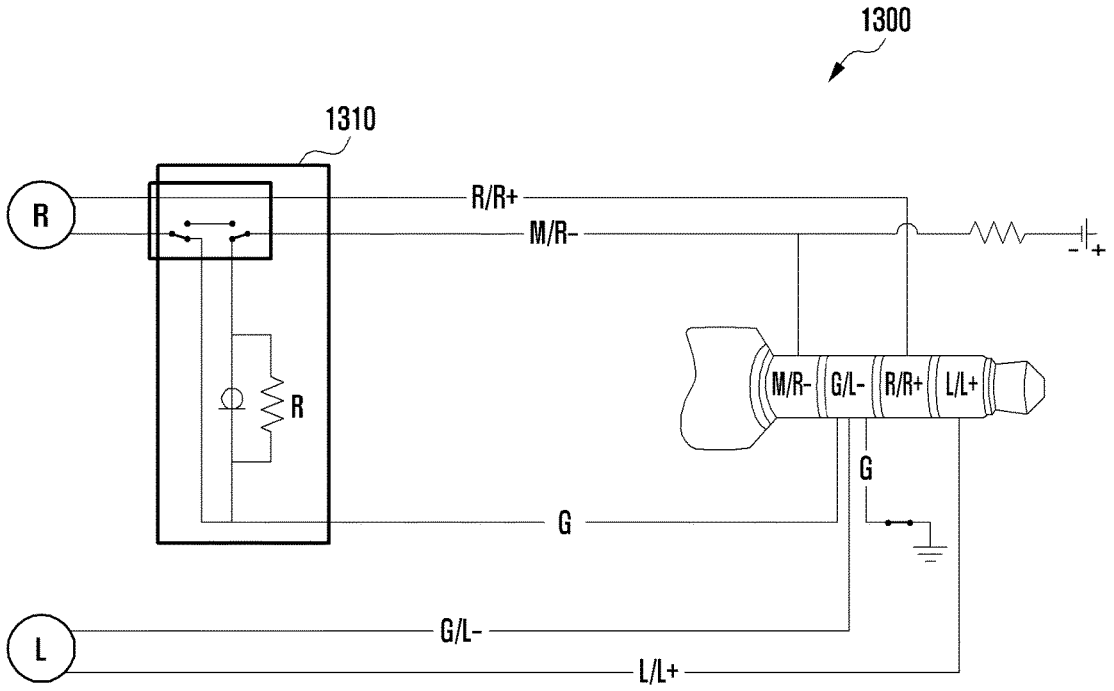

FIGS. 13A and 13B are diagrams showing circuits that describe operations to change from a balanced-type connector supporting mode to an unbalanced-type connector supporting mode, when a phone call is received while supporting the balanced-type connector, according to an embodiment of the present disclosure.

Referring to FIG. 13A, a circuit of an external output device 1300 capable of outputting balanced-type and unbalanced-type audio signals is provided. For example, the external output device 1300 includes a left output part (L), a right output part (R), and a microphone part 1310 and is connected to the electronic device via the connector. In various embodiments, the external output device 1300 is configured to be equipped with a circuit capable of outputting both balanced-type and unbalanced-type audio signals. Although the external output device 1300 shown in FIG. 13A is implemented in such a way that the connector includes L+, R+, L−, and R− contacts, it should be understood that the present disclosure is not limited thereto.

The external output device 1300 is set as a default mode to output a balanced-type audio signal. The microphone part 1310 of the external output device 1300 is not connected to the microphone installed to the external output device, but to the R− contact (SLEEVE) of the connector. The external output device 1300 receives a balanced-type audio signal from the electronic device and outputs it to the left output part (L) and the right output part (R). In this case, the RING2 contact of the connector is ungrounded (open).

Referring to FIG. 13B, a circuit of the external output device 1300, outputting an unbalanced-type audio signal via the connector is provided. The microphone part 1310 of the external output device 1300 is connected to a microphone installed to the external output device as the switch is controlled. The microphone part 1310 is connected to the SLEEVE contact of the connector and receives audio signals via the microphone. In this case, the RING2 contact of the connector is grounded.

In various embodiments, when the electronic device receives an incoming call while outputting a balanced-type audio signal, it is capable of outputting an unbalanced-type audio signal. The electronic device is also capable of providing a microphone function as the mode is switched to an unbalanced-type mode. Although it is not shown, the switch of the microphone part 1310 may be controlled according to a control signal from the electronic device or by a user's input.

Figure 14A:
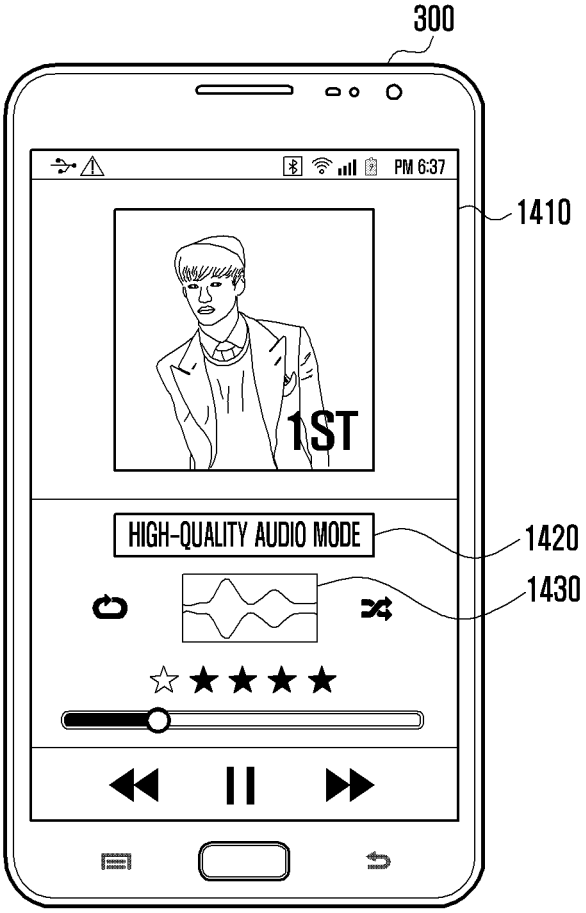
FIGS. 14A and 14B are diagrams showing a User Interface (UI) of an electronic device, altered when a balanced-type connector is connected to the electronic device, according to an embodiment of the present disclosure.
Figure 14B:
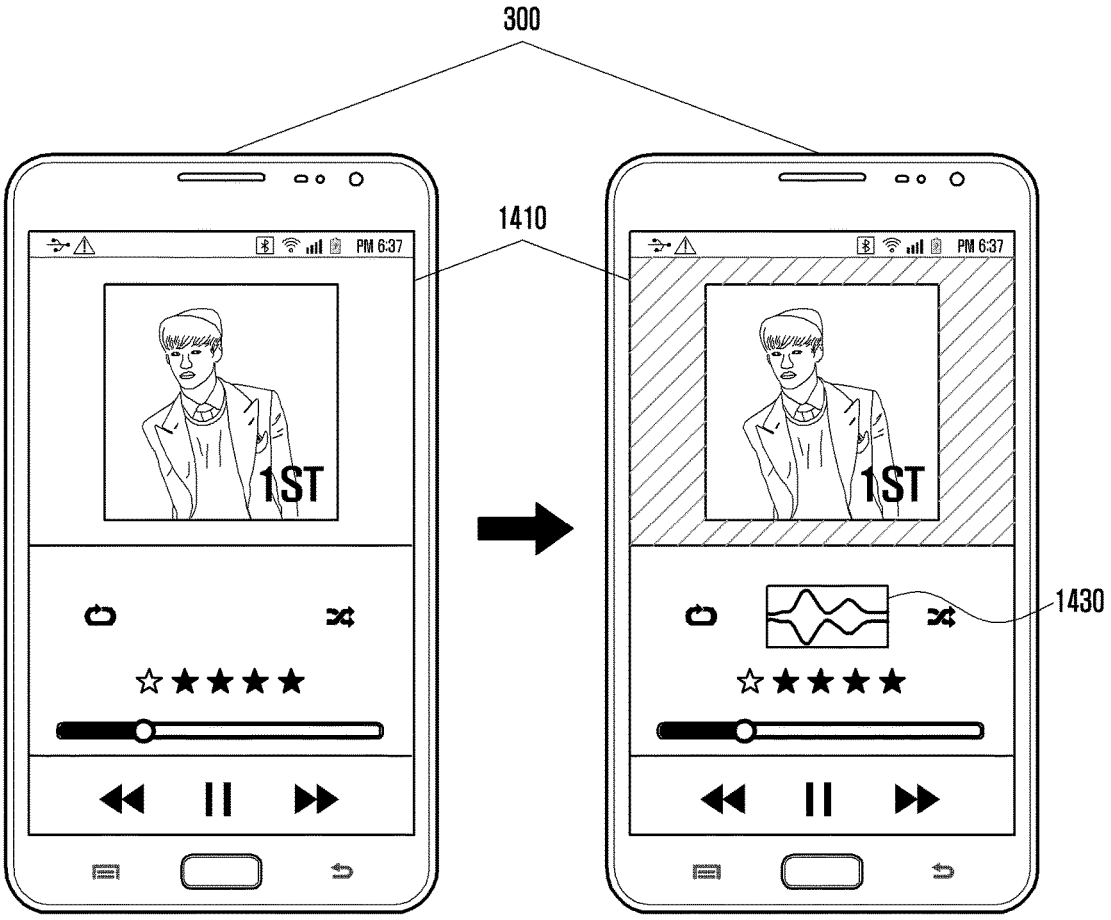

FIGS. 14A and 14B are diagrams showing a User Interface (UI) of an electronic device, altered when a balanced-type connector is connected to the electronic device, according to an embodiment of the present disclosure.

Referring to FIG. 14A, the electronic device 300 may run (activate) a music-related application 1410. Although the embodiment shown in FIG. 14A is described in such a way that the electronic device 300 runs a music-related application 1410, it should be understood that the present disclosure is not limited to the application. The electronic device 300 may also run audio-related applications or may be in an idle mode.

While running a music-related application 1410, the electronic device may be connected with a balanced-type external output device. The electronic device 300 identifies that the connected, external output device is a balanced-type, and automatically switches the mode to a high-quality audio mode (a mode for supporting a balanced-type). The electronic device 300 may display information regarding a mode switching to a high-quality audio mode via a notification window 1420. The electronic device 300 may also display a high-quality audio icon 1430 on the screen, indicating that the mode is switched to a high-quality audio mode. The high-quality audio icon 1430 may be displayed, varying in color, brightness, etc. Although not shown, the electronic device 300 may also output, to the external output device, a notification message informing that a mode is switched to a high-quality audio mode, in addition to the visual notifications.

Referring to FIG. 14B, according to another embodiment, screens informing that a mode is switched to a high-quality audio mode are provided. When the electronic device 300 is connected with a balanced-type external output device while running a music-related application 1410, it may change the background color of the application 1410 to another. The embodiment shown in FIG. 14B is implemented in such a way that the electronic device 300 changes the background color of the music-related application 1410 to another color and also displays a high-quality audio icon 1430; however, it should be understood that the present disclosure is not limited to the embodiment.

In various embodiments, the electronic device 300 detects the connection of a balanced-type external output device and automatically makes a change in UI or outputs a notification voice, thereby informing the user that the mode is switched to a high-quality audio mode. Although it is not shown, when the electronic device 300 detects the connection of a balanced-type external output device, it may display a notification widow so that the user can switch the mode to a high-quality audio mode, instead of automatically switching the mode to a high-quality audio mode.

In various embodiments of the present disclosure, the method of controlling the output based on a type of connector includes determining whether a first, second and third external connector is a inserted into a receptacle, via a circuit connected to the receptacle, wherein the receptacle is configured to receive the first, second or third external connector, each of the first and second connector includes a first number of contacts, and the third external connector includes a second number of contacts less than the first number of contacts; providing an audio output signal to the first external connector in a first manner when the first external connector is inserted to the receptacle; providing an audio output signal to the second external connector in a second manner which differs from the first manner when the second external connector is inserted to the receptacle; and providing an audio output signal to the third external connector in a third manner which differs from the first and second manners when the third external connector is inserted to the receptacle.

In various embodiments, the first and second numbers are four and three, respectively.

In various embodiments, the first external connector is connected to an external audio device including first and second speakers, with a wire; and providing an audio output signal to the first external connector in a first manner comprises: providing audio output signals to the first and second speakers via two of the first number of contacts of the first external connector. In addition, when the first external connector is inserted to the receptacle, the method further includes receiving audio output signals from the external audio device, via the two contacts and another contact from among the first number of contacts of the first external connector.

In various embodiments, the second external connector is connected to an external audio device including first and second speakers, with a wire. The method includes providing a first audio output signal to the first speaker via two of the first number of contacts of the second external connector and a second audio output signal to the second speaker via two other contacts of the first number of contacts.

In various embodiments, the determination includes measuring voltage or impedance via at least part of the contacts of the first, second or third external connector inserted to the receptacle; and identifying a type of the external connector inserted to the receptacle, based on the measured voltage or impedance. In addition, the method includes adjusting the audio output signal, based on the measured voltage or impedance; and providing the adjusted audio output signal to the first external connector.

In various embodiments, the determination includes grounding a first one of the contacts of a first, second or third external connector inserted to the receptacle; measuring voltage or impedance, between the second one of the contacts and the ground; and identifying a type of the external connector inserted to the receptacle, based on the measured voltage or impedance. The circuit of the electronic device includes a processor. The processor is configured to perform at least part of the identification step and the audio output step.

As described above, the electronic device according to various embodiments of the present disclosure supports unbalanced-type and balanced-type output devices, and thus increases user convenience. In particular, the electronic device supports a balanced-type output device and thus provides users with a high quality audio.

The term "module" according to the embodiments of the disclosure, refers to, but is not limited to, a unit of one of software, hardware, and firmware or any combination thereof. The term "module" may be used interchangeably with the terms "unit," "logic," "logical block," "component," or "circuit." The term "module" may denote a smallest unit of component or a part thereof. The term "module" may be the smallest unit of performing at least one function or a part thereof. A module may be implemented mechanically or electronically. For example, a module may include at least one of an application-specific integrated circuit (ASIC) chip, field-programmable gate arrays (FPGAs), and programmable-logic device known or to be developed for certain operations.

According to various embodiments of the present disclosure, the devices (e.g. modules or their functions) or methods may be implemented by computer program instructions stored in a computer-readable storage medium. In the case that the instructions are executed by the processor 120, the processor 120 may execute the functions corresponding to the instructions. The computer-readable storage medium may be the memory 130. At least a part of the programming module may be implemented (e.g. executed) by the processor 120. At least a part of the programming module may include modules, programs, routines, sets of instructions, and processes for executing the at least one function.

The computer-readable storage medium includes magnetic media such as a floppy disk and a magnetic tape, optical media including a compact disc (CD) ROM and a DVD ROM, a magneto-optical media such as a floptical disk, and the hardware device designed for storing and executing program commands such as ROM, RAM, and flash memory. The programs commands include the language code executable by computers using the interpreter as well as the machine language codes created by a compiler. The aforementioned hardware device can be implemented with one or more software modules for executing the operations of the various embodiments of the present disclosure.

The module or programming module of the present disclosure may include at least one of the aforementioned components with omission of some components or addition of other components. The operations of the modules, programming modules, or other components may be executed in series, in parallel, recursively, or heuristically. Also, some operations may be executed in different order, omitted, or extended with other operations.

Although various embodiments of the present disclosure have been described using specific terms, the specification and drawings are to be regarded in an illustrative rather than a restrictive sense in order to help understand the present disclosure. It is obvious to those skilled in the art that various modifications and changes can be made thereto without departing from the broader spirit and scope of the disclosure. Therefore, the scope of the present disclosure is defined, not by the detailed description and embodiments, but by the following claims and their equivalents.

What is claimed is:

1. An electronic device, comprising:

a housing;

an opening formed in one side of the housing;

a hole communicating with the opening;

a receptacle, placed inside the hole, for receiving one of first, second and third external connectors; and a circuit electrically connected to the receptacle, wherein each of the first and second external connectors comprises a first number of contacts;

the third external connector comprises a second number of contacts less than the first number of contacts;

the circuit is configured to:

measure, when one of the first, second and third external connectors is inserted into the receptacle, voltage or impedance corresponding to at least part of the contacts of the first, second and third external connectors inserted to the receptacle, identify which one of the first, second and third external connectors is inserted into the receptacle based on the measured voltage or impedance, provide, when the first external connector is inserted into the receptacle, an audio output signal to the first external connector in a first manner, provide, when the second external connector is inserted into the receptacle, an audio output signal to the second external connector in a second manner which differs from the first manner, and provide, when the third external connector is inserted into the receptacle, an audio output signal to the third external connector in a third manner which differs from the first and second manners;

the second external connector is connected to an external audio device including first and second speakers; and the circuit provides, when the second external connector is inserted to the receptacle, a first audio output signal to the first speaker via two contacts of the first number of contacts of the second external connector and a second audio output signal to the second speaker via two other contacts different from the two contacts of the first number of contacts.

2. The electronic device of claim 1, wherein the first number of contacts is four, and the second number of contacts is three.

3. The electronic device of claim 1, wherein the first external connector is connected to an external audio device including first and second speakers; and the circuit provides, when the first external connector is inserted into the receptacle, audio output signals to the first and second speakers via two contacts of the first number of contacts of the first external connector.

4. The electronic device of claim 3, wherein the circuit receives, when the first external connector is inserted to the receptacle, audio output signals from the external audio device, via another contact different from the two contacts, from among the first number of contacts of the first external connector.

5. The electronic device of claim 1, wherein the circuit comprises a processor; and the processor performs at least part of the identification of which one of the first, second and third external connectors is inserted into the receptacle and provides the audio output signal.

6. The electronic device of claim 1, wherein, when the first external connector is inserted into the receptacle, the circuit adjusts the audio output signal, based on the measured voltage or impedance, and provides the adjusted audio output signal to the first external connector.

7. The electronic device of claim 1, wherein the circuit grounds a first one of the contacts of a first, second or third external connector inserted into the receptacle and identifies the type of the external connector inserted into the receptacle, based on the measured voltage or impedance, between a second contact of the external connector and the ground.

8. A method of controlling the output based on a type of connector comprising:

determining whether one of a first, second or third external connector is inserted into a receptacle, via a circuit connected to the receptacle, wherein the receptacle is configured to receive the first, second or third external connector, each of the first and second connector includes a first number of contacts, and the third external connector includes a second number of contacts less than the first number of contacts;

measuring voltage or impedance corresponding to at least part of the contacts of the first, second and third external connectors inserted to the receptacle, identifying which one of the first, second and third external connectors is inserted into the receptacle based on the measured voltage or impedance, providing an audio output signal to the first external connector in a first manner when the first external connector is inserted into the receptacle;

providing an audio output signal to the second external connector in a second manner which differs from the first manner when the second external connector is inserted into the receptacle;

providing an audio output signal to the third external connector in a third manner which differs from the first and second manners when the third external connector is inserted into the receptacle;

the second external connector is connected to an external audio device including first and second speakers; and providing the audio output signal to the second external connector in the second manner comprises providing a first audio output signal to the first speaker via two contacts of the first number of contacts of the second external connector and a second audio output signal to the second speaker via two other contacts different from the two contacts of the first number of contacts.

9. The method of claim 8, wherein the first number of contacts is four, and the second number of contacts is three.

10. The method of claim 8, wherein the first external connector is connected to an external audio device including first and second speakers; and providing the audio output signal to the first external connector in the first manner comprises providing audio output signals to the first and second speakers via two contacts of the first number of contacts of the first external connector.

11. The method of claim 10, further comprising:

receiving, when the first external connector is inserted into the receptacle, audio output signals from the external audio device, via another contact different from the two contacts, from among the first number of contacts of the first external connector.

12. The method of claim 8, wherein providing the audio output signal to the first external connector comprises:

adjusting the audio output signal, based on the measured voltage or impedance; and providing the adjusted audio output signal to the first external connector.

13. The method of claim 8, wherein determining whether the first, second or third external connector is inserted into the receptacle further comprises:

grounding a first one of the contacts of the first, second or third external connector inserted into the receptacle; and measuring the voltage or impedance between a second contact of the external connector and the ground.

* * * * *